US006163669A

United States Patent [19]

Aoki et al.

[11] Patent Number: 6,163,669

[45] **Date of Patent: *Dec. 19, 2000**

[54] IMAGE FORMING APPARATUS

[75] Inventors: Katsuhiro Aoki, Yokohama; Takashi Hodoshima, Kawasaki; Junichi Matsumoto; Hiroyuki Matsushiro, both of Yokohama, all of Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/321,726

[22] Filed: May 28, 1999

[30] Foreign Application Priority Data

| | | | |
|---|---|---|---|
| May 29, 1998 | [JP] | Japan | 10-149106 |
| Jul. 22, 1998 | [JP] | Japan | 10-206140 |
| Jul. 30, 1998 | [JP] | Japan | 10-229339 |
| Aug. 6, 1998 | [JP] | Japan | 10-222842 |

[51] Int. Cl.[7] ..... G03G 15/00; G03G 15/08

[52] U.S. Cl. ..... 399/159; 399/265; 399/286

[58] Field of Search ..... 399/159, 162, 399/165, 222, 265, 279, 286

[56] References Cited

U.S. PATENT DOCUMENTS

| | | | |
|---|---|---|---|
| 4,755,847 | 7/1988 | Matsushiro et al. . | |
| 4,835,565 | 5/1989 | Nagatsuna et al. . | |
| 5,339,141 | 8/1994 | Suzuki et al. . | |
| 5,341,196 | 8/1994 | Hodoshima et al. . | |
| 5,424,814 | 6/1995 | Suzuki et al. . | |
| 5,430,526 | 7/1995 | Ohkubo et al. | 399/159 |
| 5,565,973 | 10/1996 | Fujishiro et al. . | |
| 5,655,193 | 8/1997 | Fujishiro et al. . | |
| 5,655,197 | 8/1997 | Okada et al. . | |
| 5,671,465 | 9/1997 | Kimura et al. . | |
| 5,778,286 | 7/1998 | Kido et al. | 399/159 |

FOREIGN PATENT DOCUMENTS

| | | |
|---|---|---|
| 4-372981 | 12/1992 | Japan . |
| 08254933 | 10/1996 | Japan . |
| 09073229 | 3/1997 | Japan . |

*Primary Examiner*—Sandra Brase

*Attorney, Agent, or Firm*—Oblon, Spivak, McClelland, Maier & Neustadt, P.C.

[57] ABSTRACT

An image forming apparatus including a cylindrical image carrier configured to carry an electrostatic latent image while rotating, and a cylindrical developer carrier configured to bear a developer and supply the developer to the image carrier by contacting the image carrier at a nip while rotating, wherein the surface of the image carrier has a friction coefficient of from about 0.1 to about 0.4. The image carrier may be an endless belt.

42 Claims, 16 Drawing Sheets

Fig. 3

Relationship between a contact pressure of the developing roller with the photoconductor and image qualities of the resultant images

| Photo-conductor | Non-treated $\mu$ = 0.57 - 0.59 | | Coated with zinc stearate $\mu$ = 0.22 - 0.25 | | Coated with silicone oil $\mu$ = 0.2 |
|---|---|---|---|---|---|
| JIS-A hardness of developing roller | 40° | 20° | 40° | 20° | 40° |
| Contact pressure of 3 g/mm | 0.035 | 0.032 | 0.006 | 0.004 | 0.009 |
| 4 g/mm | 0.035 | 0.034 | 0.008 | 0 | 0.165 |
| 6 g/mm | | | 0.005 | 0.005 | 0.021 |
| 8 g/mm | 0.021 | 0.025 | 0.008 | 0.005 | 0.013 |
| 10 g/mm | | | | 0.005 | |
| 12 g/mm | 0.024 | 0.020 | 0.005 | 0 | 0.007 |
| 14 g/mm | | | 0.009 | 0 | 0.146 |
| 16 g/mm | | | | 0 | 0.084 |
| 18 g/mm | | | | 0 | |

: An area in which good images can be obtained.

: An area in which banded fouling occurs in the resultant images.

: An area in which top ends of the resultant images are not reproduced.

: An area in which the resultant images have uneven solid images.

Numerals such as 0.035 denote a background density, i.e., the difference between an optical density of a background area of images formed on a receiving paper and an optical density of the receiving paper on which images are not formed.

IMAGE FORMING APPARATUS

BACKGROUND OF THE INVENTION

1. Field of the Invention

The present invention relates to an electrophotographic image forming apparatus such as copiers, facsimile machines and printers, and more particularly to an electrophotographic image forming apparatus including an image carrier capable of bearing an electrostatic latent image and a developer carrier capable of bearing a developer and supplying the developer to the image carrier to develop the electrostatic latent image.

2. Discussion of the Background

Currently, various developing methods are known for electrophotographic image forming apparatus. Among the developing methods, contact-type developing methods, which are disclosed, for example, in Japanese Laid-Open Patent Publication No. 9-73229, are well known and widely used because they can produce images having good dot-image reproducibility. In a typical contact-type developing method, a developing roller, which serves as a developer carrier and which bears a developer thereon, develops an electrostatic latent image formed on an image carrier while contacting the image carrier to visualize the electrostatic latent image.

However, since the image carrier contacts the developing roller on which a toner layer is held, a problem which tends to occur is that the toner held on the developing roller adheres to non-image areas of the image carrier by van der Waals forces between them, and/or a reversely charged toner included in the developer adheres to non-image areas of the image carrier by an electrostatic force, resulting in formation of background fouling in the resultant toner images formed on the image carrier.

In attempting to solve this background fouling problem, various methods have been disclosed. For example, a method is disclosed in which a pressure of contact of a developing roller with an image carrier is increased. In the contact-developing methods, the rotation of an image carrier tends to be affected by vibration of a developing roller which is caused by the vibration of a driving device and/or a drive-transmitting device which drive the developing roller, and thereby the image carrier rotates unevenly, resulting in formation of so-called "banded fouling", which is fouling like horizontal stripes, in the resultant toner image. When the pressure of contact of the developing roller with the image carrier is increased under such circumstances, a problem which occurs is that serious banded fouling is observed in the resultant toner images.

In attempting to solve the background fouling problem, a method is disclosed in which a linear velocity of rotation of a developing roller is set to be relatively high compared to that of an image carrier. For example, Japanese Laid-Open Patent Publication No. 9-73229 discloses a method in which a developing roller having a one-component developer layer thereon contacts an image carrier to develop an electrostatic latent image formed on the image carrier, wherein the rotation of the developing roller is set so as to be from 1.2 to 3.0 times, preferably from 1.5 to 2.5 times, as high as that of the image carrier. However, the increase of rotation of the developing roller causes not only banded fouling, but also another undesired image, so-called "toner deviation in solid toner images" in which a rear end of a solid image has a relatively high image density compared to the other portion of the solid image.

In addition, in attempting to solve the background fouling problem, Japanese Laid-Open Patent Publication No. 8-254933 discloses an image forming apparatus having a toner density detecting device which detects a toner density of non-image areas of an image carrier and a lubricant-coating controlling device which controls an amount of a lubricant to be coated on the image carrier based on the information of the toner density detected by the toner density detecting device. The coating amount of the lubricant is controlled by adjusting the pressure of contact of the lubricant coating device with the image carrier. However, when the contact pressure of the lubricant coating device is increased, banded fouling problem, which occurs by the same mechanism as in the case mentioned above, tends to occur.

Because of these reasons, a need exists for an image forming apparatus that can produce images having good image qualities without background fouling such as banded fouling.

SUMMARY OF INVENTION

Accordingly, an object of the present invention is to provide an image forming apparatus that can produce images having good image qualities without background fouling such as banded fouling.

Another object of the present invention is to provide an image forming apparatus that can produce good solid images having a uniform image density.

Briefly these objects and other objects of the present invention as hereinafter will become more readily apparent can be attained by an image forming apparatus including a cylindrical image carrier configured to bear an electrostatic latent image while rotating, and a cylindrical developer carrier configured to bear a developer and supply the developer to a surface of the image carrier by contacting the surface of the image carrier while rotating to develop the electrostatic latent image, wherein the surface of the image carrier has a friction coefficient of from about 0.1 to about 0.4.

The friction coefficient of the surface of the developer carrier is preferably greater than that of the image carrier and less than about 0.6.

Preferably the JIS-A hardness of at least one of the image carrier and the developer carrier is from about 10 to about 65° when measured based on JISK6301-1996.

The surface of the developer carrier preferably has a ten-point mean roughness of from about 1 to about 6 $\mu$m.

The pressure of contact of the image carrier with the developing roller is preferably from about 3 to about 16 g·f/mm.

In addition, the ratio Vd/Vp of a peripheral speed Vp of the image carrier to a peripheral speed Vd of the developing roller is preferably from about 1.0 to about 1.35.

The image carrier may be an endless belt-shaped image carrier. In this case, the pressure of contact of the image carrier with the developing roller is preferably not greater than about 2 g·f/mm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 3 is a chart illustrating the relationship between a pressure of contact of the developing roller with the photoconductor and image qualities of the resultant images in the image forming apparatus shown in FIG. 1;

DETAILED DESCRIPTION OF THE INVENTION

Hereinafter a first embodiment of the present invention will be explained.

Figure 1:
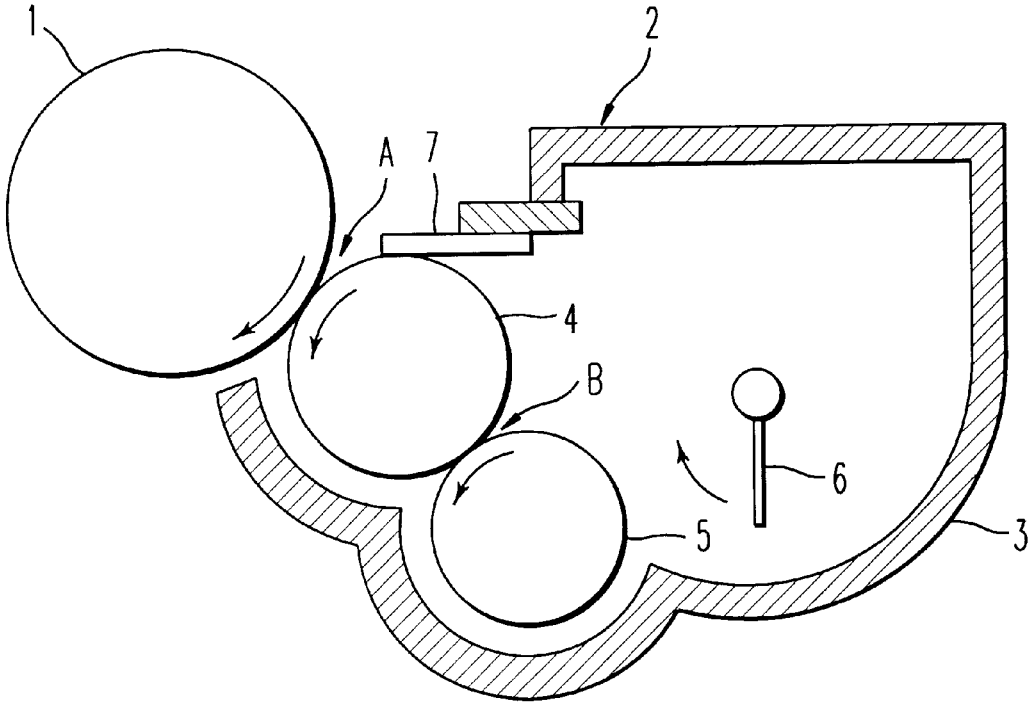
FIG. 1 is a schematic view illustrating a primary part of an embodiment of the image forming apparatus of the present invention.

FIG. 1 is a schematic view illustrating a primary part of an embodiment of the image forming apparatus of the present invention. A cylindrical photoconductor drum 1 serves as an image carrier. The photoconductor drum 1 includes an inorganic photoconductor and/or an organic photoconductor. A developing device 2 is provided on the right side of the photoconductor drum 1. Known devices such as a charging device, a light image writing device, a toner image transfer device, a cleaning device and a discharging device are disposed around the photoconductor drum 1, although they are not shown in FIG. 1.

The photoconductor drum 1 is entirely charged with a known charging device so as to have a predetermined surface potential. Imagewise light irradiates the charged photoconductor drum 1 with a known light image writing device to form an electrostatic latent image on the photoconductor drum 1. The electrostatic latent image is developed with the developing device 2.

The developing device 2 includes a casing 3 having an opening which faces the surface of the photoconductor drum 1, a developing roller 4 which serves as a developer carrier capable of bearing a developer thereon and which is configured to contact the photoconductor drum 1, a developer supplying roller 5 which is configured to contact the developing roller 4 and which also bears the developer thereon, an agitator 6 and a developer regulating blade 7.

The agitator 6 agitates a developer (not shown) such as one-component developer which is contained in a developer containing portion formed in the right part of the casing 3, and supplies the developer (hereinafter referred to as the toner) to the developer supplying roller 5. The developer supplying roller 5, which rotates in a direction shown by an arrow, supplies the toner to the surface of the developing roller 4 at a nip B. The developing roller 4 partially projects from the opening of the casing 3 and rotates in a direction shown by an arrow, i.e., in the same direction as the rotating direction of the toner supplying roller 5. The toner transferred on the developing roller 4 is regulated by the developer regulating blade 7 such that a toner layer having a uniform thickness is formed on the surface of the developing roller 4. By the rotation of the developing roller 4, the toner layer is fed to a nip A, at which the developing roller 4 contacts the photoconductor drum 1, to develop an electrostatic latent image on the photoconductor drum 1. The electrostatic latent image is developed while the photoconductor 1 rotates in a direction shown by an arrow, i.e., in the reverse direction of the rotating direction of the developing roller 4. Thus, a toner image corresponding to the electrostatic latent image is formed on the photoconductor drum 1.

In the present invention, the friction coefficient of the surface of the photoconductor drum 1 is preferably set so as to be in a range of from about 0.1 to about 0.4 to prepare toner images having good image qualities without background fouling. The friction coefficient is measured by an Euler belt method.

Figure 2A:
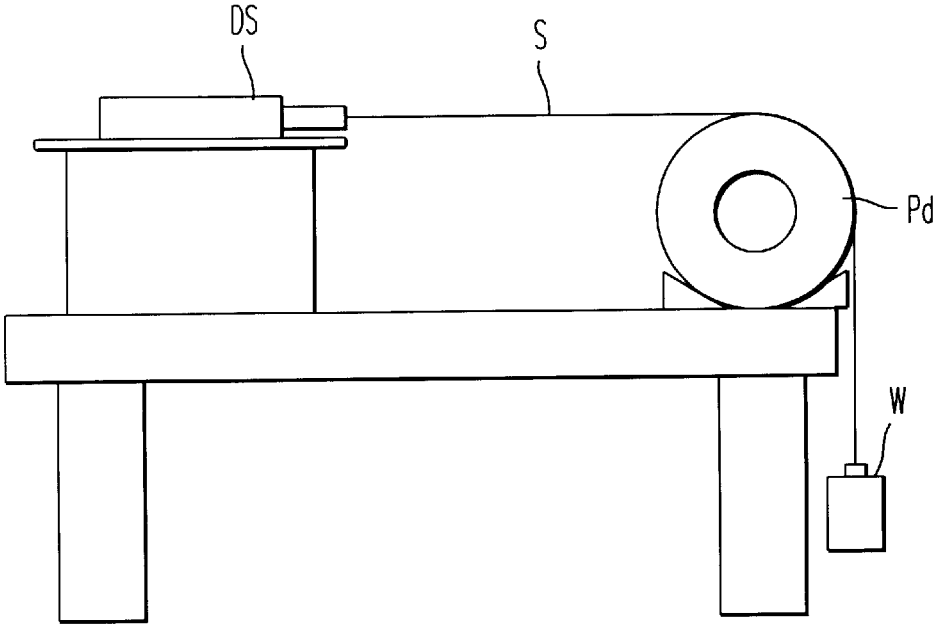
FIG. 2A is a schematic view illustrating a measuring instrument in which a friction coefficient of the surface of a cylindrical photoconductor is measured by an Euler belt method.

FIG. 2A is a schematic view illustrating a measuring instrument in which the friction coefficient of the surface of a photoconductor drum 1 is measured by an Euler belt method.

In FIG. 2A, character S denotes a belt-shaped paper sheet which has a medium thickness (#6200 paper manufactured by Ricoh Co., Ltd.) and a dimension of 30 mm in width and 297 mm in length. At this point, the paper sheet is cut so that the longer edge of the paper sheet is parallel to the machine direction in the paper manufacturing process. Two hooks are set at each shorter edge of the paper sheet S, and a load W (0.98N, i.e., 100 g) is set at one hook and a digital force gauge DS is set at the other hook. As shown in FIG. 2A, the paper sheet S is set in the measuring instrument such that the paper sheet S contacts a quarter portion of the circumference of a photoconductor drum Pd. The paper sheet S is pulled horizontally with the digital force gauge DS while the load W is controlled so as not to dance. Provided when a force at which the paper S starts to move is F (unit: N), the coefficient $\mu$ of static friction of the photoconductor drum Pd is determined by the following equation (1):

$$\mu=(2/\pi)\ln(F/0.98) \quad (1)$$

By imparting a friction coefficient of from about 0.1 to about 0.4 to the photoconductor drum 1, a toner, which is held on the developing roller 4 and which contacts the surface of the photoconductor drum 1 while being abraded by the surface, does not adhere to the surface of the photoconductor drum 1, and therefore good images without background fouling can be obtained. The friction coefficient of the photoconductor drum 1 can be obtained, for example, by coating a lubricant on the surface of the photoconductor drum 1. The initial friction coefficient of a raw photoconductor drum 1 on which a lubricant is not coated is from about 0.4 to about 0.6, and when the raw photoconductor drum 1 is used for a long time, the friction coefficient increases with time. By coating a lubricant on the surface of a photoconductor drum 1, the photoconductor drum 1 whose surface has a friction coefficient of from about 0.1 to about 0.4 can be prepared.

In order to maintain the friction coefficient of the surface of the photoconductor drum 1 in the preferable range of from about 0.1 to about 0.4, a lubricant is always coated or coated at regular intervals on the surface of the photoconductor drum 1, for example, by a lubricant applying device.

Suitable toners for use in the developing device 2 include toners which include colored particles including a binder resin such as polyester resins, polyols and styrene-acrylate copolymers, a charge controlling agent and a colorant, and a material such as silica and titanium oxide which is mixed with the colored particles. A suitable particle diameter of the toners is from about 3 to about 12 $\mu$m, and in the first embodiment of the present invention a toner having a particle diameter of 7.5 $\mu$m is used to obtain images having good resolution.

The developing roller 4 is mainly made of a substrate of an elastic material such as rubbers, and preferably has a JIS-A hardness of from 10 to 65° which is defined and measured based on JISK6301-1996. The developing roller may be a roller in which an elastic material layer is formed on the peripheral surface of a hard roller such as a metal roller. The outside diameter of the developing roller 4 is preferably about 10 to about 30 mm, and the surface thereof preferably has a ten-point mean roughness Rz of from about 1 to about 6 $\mu$m. Since the surface of the developing roller 4 has such a ten-point mean roughness Rz, i.e., the surface roughness thereof is designed so as to be from 13 to 80% of the particle diameter (7.5 $\mu$m) of the toner used, the toner particles can be fed without going into the developing roller 4. Suitable rubbers for use in the developing roller 4 include silicone rubbers, butadiene rubbers, nitrile-butadiene rubbers, hydrin rubbers and ethylene-propylene-diene-methylene rubbers (EPDM). The surface of the developing roller 4 may be coated with a coating material such as silicone materials and fluorine-containing materials. Silicone materials can impart a satisfactory charge to a toner, and fluorine-containing materials can impart good releasability to the developing roller 4. In addition, electroconductive materials such as carbon black can be included in the developing roller 4 to improve electroconductivity thereof. A suitable thickness of the coating layer of the developing roller 4 is from about 5 to about 50 $\mu$m to avoid breaking of the coating layer.

The JIS-A hardness of the developing roller 4 is preferably from about 10 to about 65°. When the hardness is excessively less than the lower limit, the developing roller 4 tends to shrink or expand during a molding process, and therefore it is difficult to mold a high-precision roller. In addition, when a soft roller is prepared, it is general to add an oil compound to a roller. However, when an oil compound is excessively added to a roller, a problem which tends to occur is that the oil bleeds out of the developing roller 4 by a pressure applied to the developing roller 4 during a developing process, thereby contaminating the toner, which results in deterioration of the developing ability of the toner.

The developing roller 4 contacts the photoconductor drum 1 with a toner layer therebetween upon application of pressure with coil springs or plate springs. In the present invention, when a roller having a JIS-A hardness of 30° is used as the developing roller 4, the pressure of contact of the developing roller 4 with the photoconductor drum 1 is set so as to be from 3 to 16 g·f/mm. The more the springs are used to press the developing roller 4, the better the contact of the developing roller 4 with the photoconductor drum 1, resulting in formation of solid images having a uniform image density.

The preferable range of the contact pressure mentioned above is determined based on the following experimental results.

FIG. 3 is a chart illustrating the relationship between a pressure of contact the developing roller 4 with the photoconductor drum 1 and image qualities of the resultant toner images. In FIG. 3, numerals denote a background density, i.e., the difference between an optical density of a background area of images formed on a receiving paper and an optical density of the receiving paper on which images are not formed. The columns surrounded by a wide solid line denote an area in which the toner images have good images qualities. The columns surrounded by slant lines denote an area in which the resultant images have a defect of uneven solid images. The columns surrounded by vertical lines denote an area in which the resultant images have a defect in which a top end of the developed images is not reproduced. The columns surrounded by horizontal lines denote an area in which the resultant images have a defect of the "banded fouling". In this experiment, the ratio, Vd/Vp, of the peripheral speed Vp of the image carrier to the peripheral speed Vd of the developing roller is set so as to be 1.2. The target value of the background density is less than 0.02.

When the contact pressure is less than the lower limit of the preferable range mentioned above, the developing ability of the developing roller 4 deteriorates and therefore image density decreases. In contrast, when the contact pressure is greater than the upper limit of the preferable range mentioned above, an undesired image such as an uneven solid image tends to be produced. This is because the toner once transferred on the photoconductor drum 1 is scavenged by the developing roller 4 or the toner to be transferred to the photoconductor drum 1 remains on the developing roller 4 due to the excessive pressure.

Figure 9A:
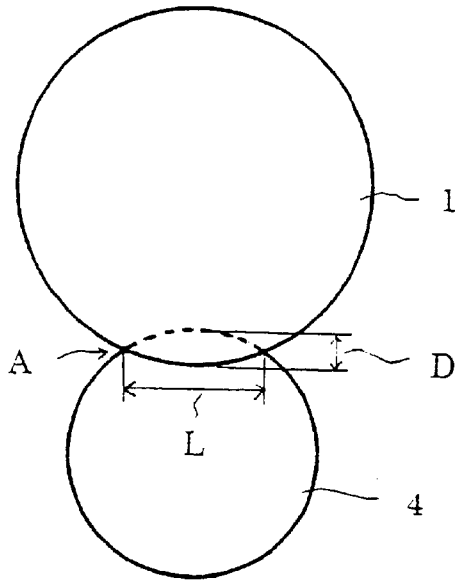
FIG. 9A is a schematic view illustrating the nip portion of a developing roller and a cylindrical photoconductor.
Figure 9B:
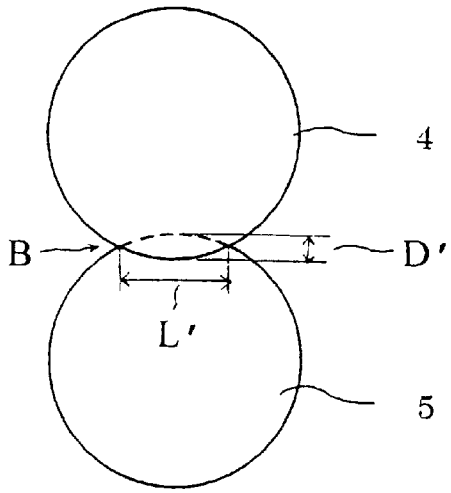
FIG. 9B is a schematic view illustrating the nip portion of a developer supplying roller and a developing roller.

The developer supplying roller 5 is preferably made of an elastic material such as foamed polyurethane. The developer supplying roller 5 preferably has cells having a diameter of from about 50 to about 500 $\mu$m to easily hold toner particles on the surface thereof. In addition, the developer supplying roller 5 preferably has a JIS-A hardness of from about 10 to about 30° so that the developer supplying roller 5 can uniformly contact the developing roller 4. When the developer supplying roller 5 contacts the developing roller 4, the depth of deformation formed on the surface of the developer supplying roller 5 or the developing roller 4 is preferably set so as to be in a range of from about 0.5 to about 1.5 mm. FIG. 9B is a schematic view illustrating an embodiment of the nip of the developing roller 4 and the developer supplying roller 5. Character D' denotes the depth of deformation of the developer supplying roller 5 and character L' denotes a nip width. In this case, the developer supplying roller 5 has a relatively low hardness compared to the developing roller 4, but the developer supplying roller 5 may have a higher hardness than the developing roller 4. In addition, the ratio of the linear speed of the developer supplying roller 5 to that of the developing roller 4 is preferably from 0.5 to 1.5. In the present embodiment, the ratio is set so as to be 0.9. The rotating direction of the developer supplying roller 5 is the same as that of the developing roller 4. By contacting the developer supplying roller 5 with the developing roller 4 such that the depth of deformation of the developer supplying roller 5 falls in the range of from about 0.5 to about 1.5 mm, a torque of 1.5 to 2.5 kg·fcm can be obtained which is suitable for developing an latent image having an effective width of 240 mm, which is needed for preparing a copy sheet having a A-4 size when the sheet is fed so that the longer edge of the sheet is parallel to the paper feeding direction. The preferable ranges of the depth of deformation and the linear speed ratio depend on the characteristics of a motor and gears used in the developing device 2, and charging properties of the toner used. Therefore, the preferable ranges thereof can be widened by optimizing the characteristics and properties of these elements.

The toner held on or in the developer supplying roller 5 is then transferred onto the surface of the developing roller 4 by a negative charge induced by the friction of the developer supplying roller 5 with the developing roller 4 at the nip B. In addition, the toner is fed while being held on the developing roller 4 because the developing roller 4 has a proper surface roughness. Since the toner transferred onto the developing roller 4 has an uneven thickness and in addition the amount of the toner adhered to the developing roller 4 is too excess (from 1 to 3 mg/cm$^2$), the toner is regulated by the developer regulating blade 7 such that a thin toner layer having a uniform thickness can be formed on the developing roller 4. In the first embodiment, the rotating direction of the developer supplying roller 5 is the same as that of the developing roller 4, but is not limited thereto.

One side of the developer regulating blade 7 is supported by the casing 3, and the developer regulating blade 7 extends so as to contact the developing roller 4 such that the angle formed by the developer regulating blade 7 and the tangent line of the developing roller 4 at the contacting point is from about 10 to about 45°. The developer regulating blade 7 is configured so as to extend in the same direction as the rotating direction of the developing roller 4 and a portion of the body of the blade 7 touches the developing roller 4 to regulate the toner layer. Suitable materials for use as the developer regulating blade 7 include a blade of a metal such as SUS304, which has a thickness of from about 0.1 to about 0.15 mm. The length of the portion of the blade 7, which is projected form the casing 3, is preferably from about 10 to about 15 mm. In the first embodiment, when the hardness of the developing roller 4 is 30°, a SUS plate having a thickness of 0.1 mm is used for the developer regulating blade 7 and the contact pressure thereof is 60 g·f/cm.

By controlling the length of the portion of the developer regulating blade 7, which projects from the casing 3, in the range of from about 10 to about 15 mm, problems can be avoided in that the developing device 2 cannot be miniaturized and a uniform toner layer cannot be formed on the developing roller 4 due to the vibration of the developer regulating blade 7, which results in formation of an undesired image having uneven image densities. In addition, by controlling the contacting pressure of the developer regulating blade 7, images having a uniform image density can be obtained and a problem in that the resultant image has black spots caused by passage of aggregates of the toner particles through the contact point of the developing roller 4 and the developer regulating blade 7 can be avoided.

The toner held on the developing roller 4 is regulated with the developer regulating blade 7 so that a uniform thin toner layer of from about 0.4 to about 0.8 mg/cm$^2$ is formed on the developing roller 4. In addition, by this developer regulating operation the toner of the resultant thin toner layer is charged so as to have a charge quantity of from about −5 to about −30 $\mu$C/g, and then supplied to the photoconductor drum 1 to develop an electrostatic latent image. In the first embodiment, when the diameters of the photoconductor drum 1 and the developing roller 4 are 50 mm and 16 mm, respectively, the hardness of the developing roller 4, the contacting pressure and the depth D of deformation of the developing roller 4 are controlled so that the developing area at the nip A is from about 5 to about 10 mm. The depth D is defined as shown in FIG. 9A. Thus, the electrostatic latent image formed on the photoconductor drum 1 is developed, resulting in formation of a visual image on the photoconductor drum 1.

In order to obtain good images, the surface of the developing roller 4 is preferably uniform and the contact of the developing roller 4 with the photoconductor drum 1 is preferably maintained so as to be uniform.

In order to maintain the contact of the developing roller 4 with the photoconductor drum 1 so as to be uniform, it is important to control the depth D of deformation of the developing roller 4 and the pressure of contact of the developing roller 4 with the photoconductor drum 1 so as to be uniform. The depth D of deformation affects the toner supplying properties of the developing roller 4 and is affected by the surface smoothness, variation of the outside diameter and eccentric rotation of the developing roller 4. The contact pressure affects the adhesion of the toner to the background area of electrostatic latent images formed on the photoconductor drum 1.

As can be understood from FIG. 3, when a roller having a JIS-A hardness of 40° (referred to as a roller A) is used as the developing roller 4, good images can be obtained by setting the contact pressure so as to fall in a range of from about 3 to about 8 g·f/mm. In contrast, when a roller having a JIS-A hardness of 20° (referred to as a roller B) is used, good images can be obtained by setting the contact pressure so as to fall in a range of from about 3 to about 16 g·f/mm.

Figure 4:
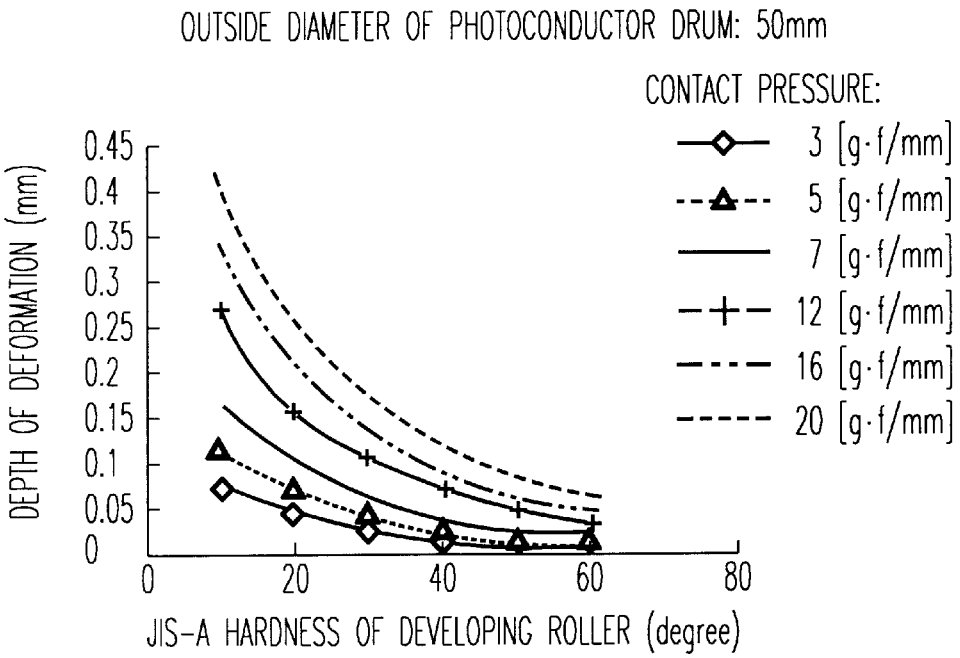
FIG. 4 is a graph illustrating the relationship between a hardness of the developing roller and a depth of deformation of the developing roller when the contact pressure is a parameter the image forming apparatus shown in FIG. 1.

FIG. 4 is a graph illustrating the relationship between a hardness of the developing roller 4 and a depth D of deformation of the developing roller 4 when the contact pressure is a parameter.

As can be understood from FIG. 4, when the contact pressure of roller A is controlled so as to be from about 3 to about 8 g·f/mm, the depth D of deformation of the developing roller 4 should be controlled so as to fall in a range of from about 0.03 to about 0.05 mm, i.e., the tolerance is about 0.02 mm. When the contact pressure of roller B is controlled so as to be from about 3 to about 16 g·f/mm, the depth D of deformation of the developing roller 4 should be controlled so as to fall in a range of from about 0.05 to about 0.22 mm, i.e., the tolerance is about 0.17 mm. Therefore, when roller A is used as the developing roller 4, the size of the developing roller 4 should be controlled more severely than in the case when roller B is used.

In the first embodiment, the surface of the developing roller 4 is preferably coated with a material which preferably has releasability and abrasion resistance. In general, a roller having a relatively low hardness has poor resistance to abrasion. Therefore, it is preferable for preparing the developing roller 4 to coat a hard material on a roller having a relatively low hardness. By thus preparing the developing roller 4, a developing roller 4, the outside diameter of which is severely controlled and which has good abrasion resistance, can be easily manufactured without a complicated process.

The present inventors discover that the nip width L of the nip A affects image qualities of solid images. The nip width L is defined as shown in FIG. 9A. This point will be explained referring to FIGS. 5 and 6.

According to our experiments, when the nip width L of the nip A is greater than about 2 mm, solid images having good evenness cannot be obtained. This is because the toner once transferred on the photoconductor drum 1 is excessively scavenged by the developing roller 4.

Figure 5:
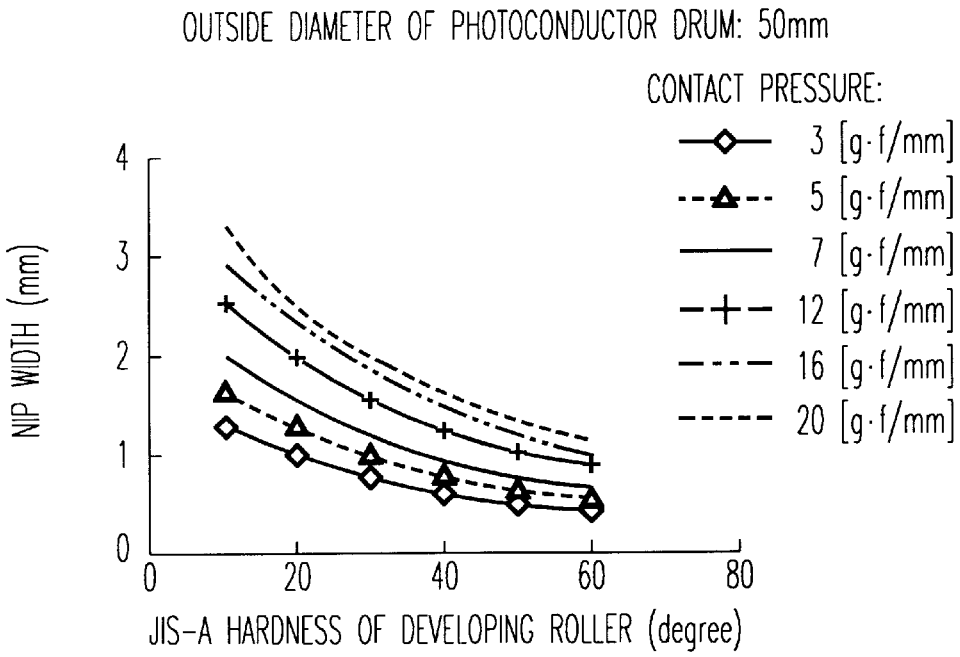
FIG. 5 is a graph illustrating the relationship between a hardness of the developing roller and a nip width at the nip of the developing roller with the photoconductor when the contact pressure is a parameter and the photoconductor has an outside diameter of 50 mm in the image forming apparatus shown in FIG. 1.

FIG. 5 is a graph illustrating the relationship between a JIS-A hardness of the developing roller 4 and a nip width L at the nip A of the developing roller 4 and the photoconductor drum 1 when the contact pressure is a parameter. As can be understood from FIG. 5, the nip width L depends on the hardness of the developing roller 4 and the pressure of contact of the developing roller 4 with the photoconductor 1.

Figure 6:
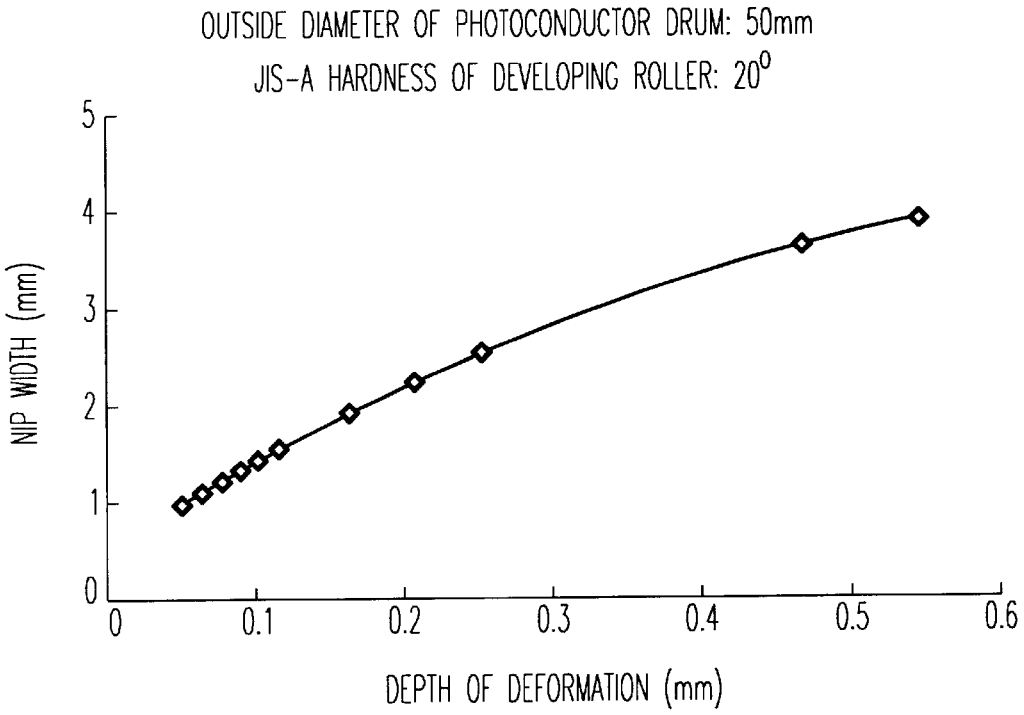
FIG. 6 is a graph illustrating the relationship between a depth of deformation of the developing roller and a nip width at the nip of the developing roller with the photoconductor when the outside diameter of the photoconductor is 50 mm and the hardness of the developing roller is 20° in the image forming apparatus shown in FIG. 1.

FIG. 6 is a graph illustrating the relationship between a depth D of deformation of the developing roller 4 and a nip width L at the nip A when the hardness of the developing roller 4 is 20°. In order to obtain good images, the depth D of deformation of the developing roller 4 and the hardness of the developing roller 4 should be controlled so that the nip width L at the nip A is not greater than about 2.0 mm. Namely, when the JIS-A hardness of the developing roller 4 is 20°, the depth D of deformation is preferably controlled so as to be not greater than about 0.19 mm in order to obtain a nip width of not greater than 2 mm. As can be understood from FIG. 5, if the contact pressure is 12 g·f/mm when the hardness of the developing roller 4 is 20°, a nip width L of not greater than 2 mm can be obtained. Similarly, if the contact pressure is 20 g·f/mm when the hardness of the developing roller 4 is 40°, a nip width of not greater than 2 mm can also be obtained. By thus controlling these parameters, good images in which solid images have good evenness can be obtained.

The nip width L at the nip A can also be controlled by controlling the ratio of the outside diameter of the photoconductor drum 1 and the outside diameter of the developing roller 4. This point will be explained referring to FIGS. 7 and 8.

Provided when the outside diameter of the photoconductor 1 is $d_p$ and the outside diameter of the developing roller 4 is $d_d$, the ratio R, $d_p/d_d$, is preferable less than 6. Namely, the following inequality is given:

$$R=(d_p/d_d)<6.$$

Figure 7:
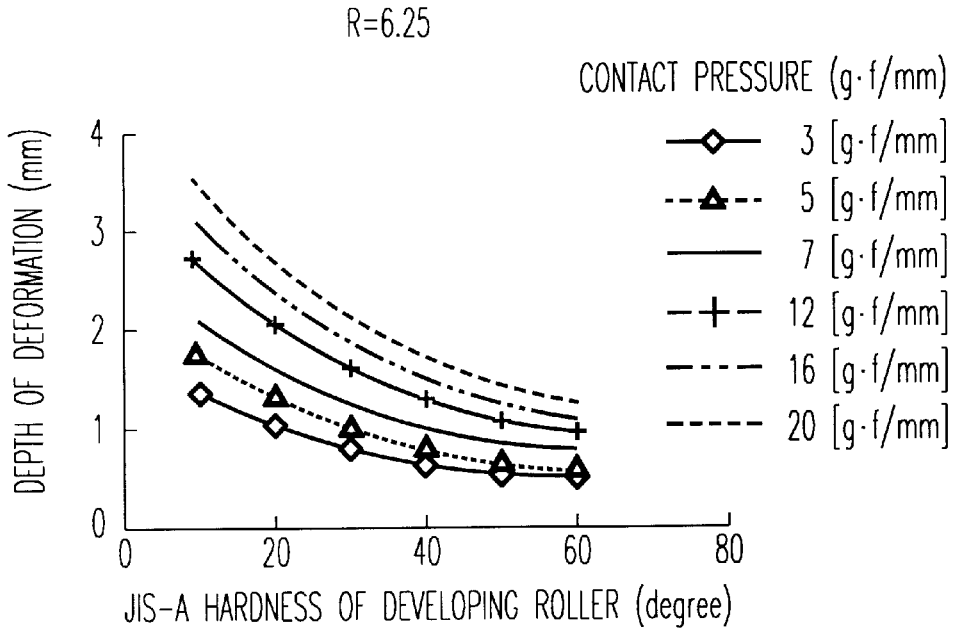
FIG. 7 is a graph illustrating the relationship between a hardness of the developing roller and a nip width at the nip of the developing roller and the photoconductor when the contact pressure is a parameter and the ratio R is 6.25 in the image forming apparatus shown in FIG. 1.
Figure 8:
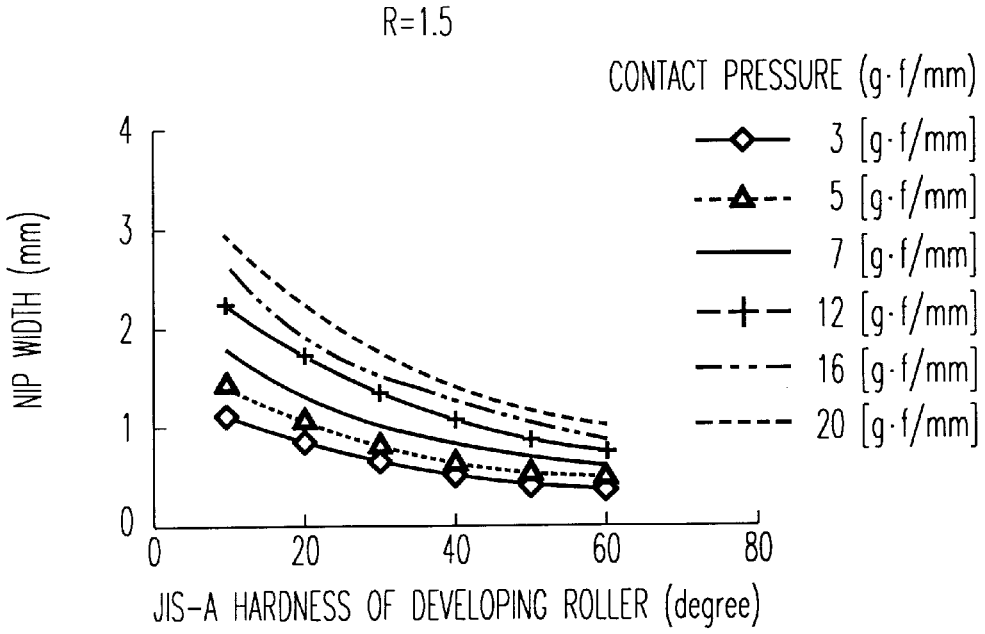
FIG. 8 is a graph illustrating the relationship between a hardness of the developing roller and a nip width at the nip of the developing roller with the photoconductor when the contact pressure is a parameter and the ratio R is 1.5 in the image forming apparatus shown in FIG. 1.

FIG. 7 is a graph illustrating the relationship between a JIS-A hardness of the developing roller 4 and a nip width L when the contact pressure is a parameter and the ratio R is 6.25. FIG. 8 is a graph illustrating the relationship between a JIS-A hardness of the developing roller 4 and a nip width L when the contact pressure is a parameter and the ratio R is 1.5. As can be understood from FIG. 7, since the ratio R is 6.25, i.e., greater than 6, the nip width L is greater than 2 mm if the hardness of the developing roller 4 is 20° and the contact pressure is 12 g·f/mm. Therefore images having uneven solid images are formed. As shown in FIG. 8, when the ratio R is 1.5 (the outside diameter of the photoconductor drum 1 is 24 mm and the outside diameter of the developing roller 4 is 16 mm), the contact pressure can be increased so as to be not greater than 16 g·f/mm. Therefore the tolerance of the contact pressure is widened, and good images can be easily obtained without severely controlling the contact pressure.

In the coating layer of the developing roller 4, an electroconductive material such as carbon black can be included.

As for the developer regulating blade 7, a plate having a thickness of from about 1 to about 2 mm which is made of resins or rubbers, e.g., elastic rubbers such as polyurethane rubbers; silicone resins; and fluorine-containing resins such as ethylene-tetrafluoroethylene copolymers (ETFE), polytetrafluoroethylene (PTFE) and polyvinylidene fluoride (PVDF), can also be used. In addition, an electroconductive material such as carbon black can be included therein.

A voltage can be applied to the developer regulating blade 7 to generate an electric field between the developer regulating blade 7 and the developing roller 4.

In the first embodiment, the hardness of the developing roller 4 is set to be much less than that of the photoconductor drum 1. However, a combination in which the hardness of the photoconductor 1 is much less than that of the developing roller 4 can also be available. In this case, the JIS-A hardness of the photoconductor drum 1 is preferably from about 10 to about 65°.

Next, the second embodiment of the present invention will be explained.

The construction of the second embodiment of the image forming apparatus of the present invention is the same as that of the first embodiment, and therefore the second embodiment is explained referring to FIG. 1. The ratio Vd/Vp of the peripheral speed Vp of the image carrier to the peripheral speed Vd of the developing roller is preferably not less than about 1.0, and more preferably from about 1.0 to about 1.35.

Conventionally, it is needed to keep the ratio Vd/Vp in a range of from 1.5 to 2.5 in order to prevent occurrence of background fouling. However, in the present invention, since the friction coefficient of the surface of the photoconductor drum 1 is relatively low (from about 0.1 to about 0.4), background fouling tends not to occur even when the ratio Vd/Vp is decreased. When the ratio Vd/Vp is decreased so as to be not greater than about 1.35, the banded fouling problem and the uneven image density problem can be avoided. However, the ratio is less than about 1.0, images having good image density cannot be formed. Therefore, the ratio Vd/Vp is preferably controlled so as to fall in a range of from about 1.0 to about 1.35.

Next, a third embodiment of the present invention will be explained.

The construction of the third embodiment of the image forming apparatus is the same as that of the first embodiment of the present invention, and therefore the third embodiment is explained referring to FIG. 1. The friction coefficient of the developing roller 4 is preferably higher than that of the photoconductor 1, and is preferably not greater than about 0.6.

When the friction coefficient of the developing roller 4 is lower than that of the photoconductor 1, the toner which once adheres to the background part of electrostatic latent images formed on the photoconductor 1 cannot scavenged by the developing roller 4, and therefore the background fouling problem occurs. In contrast, when the friction coefficient of the developing roller 4 is higher than 0.6, the torque increases, which is caused by the contact between the developing roller 4 and the photoconductor 1, resulting in uneven rotation of the developing roller 4 and the photoconductor 1, and thereby the banded fouling problem occurs.

By controlling the friction coefficient of the developing roller 4 so as to be higher than that of the photoconductor 1 and not greater than about 0.6, images having good image qualities can be obtained.

In the image forming apparatus of the present invention, the ten-point mean roughness Rz of the surface of the developing roller 4 is preferably in a range of from about 1 to about 6 $\mu$m. The ten-point mean roughness Rz (hereinafter referred to as the roughness Rz) is defined and measured based on JIS B0601-1982. When the roughness Rz is less than the lower limit, the friction coefficient of the developing roller 4 tends to be less than that of the photoconductor drum 1, resulting in occurrence of the background fouling problem. In addition, when the roughness Rz is less than the lower limit, the toner feeding ability of the developing roller 4 deteriorates, and therefore the resultant images have a relatively low image density.

In contrast, when the roughness Rz is greater than the upper limit, toner particles tend to go into the concave portions of the developing roller 4, and therefore a uniform thin toner layer cannot be formed on the developing roller 4, resulting in formation of undesired images such as images having an uneven image density. In addition, when the roughness Rz is greater than the upper limit, the friction coefficient of the surface of the developing roller 4 increases, resulting in occurrence of the banded fouling problem.

By controlling the roughness Rz of the developing roller 4 so as to fall in a range of from about 1 to about 6 $\mu$m, images having good image qualities can be obtained.

Next, the fourth embodiment of the present invention will be explained.

Figure 10:
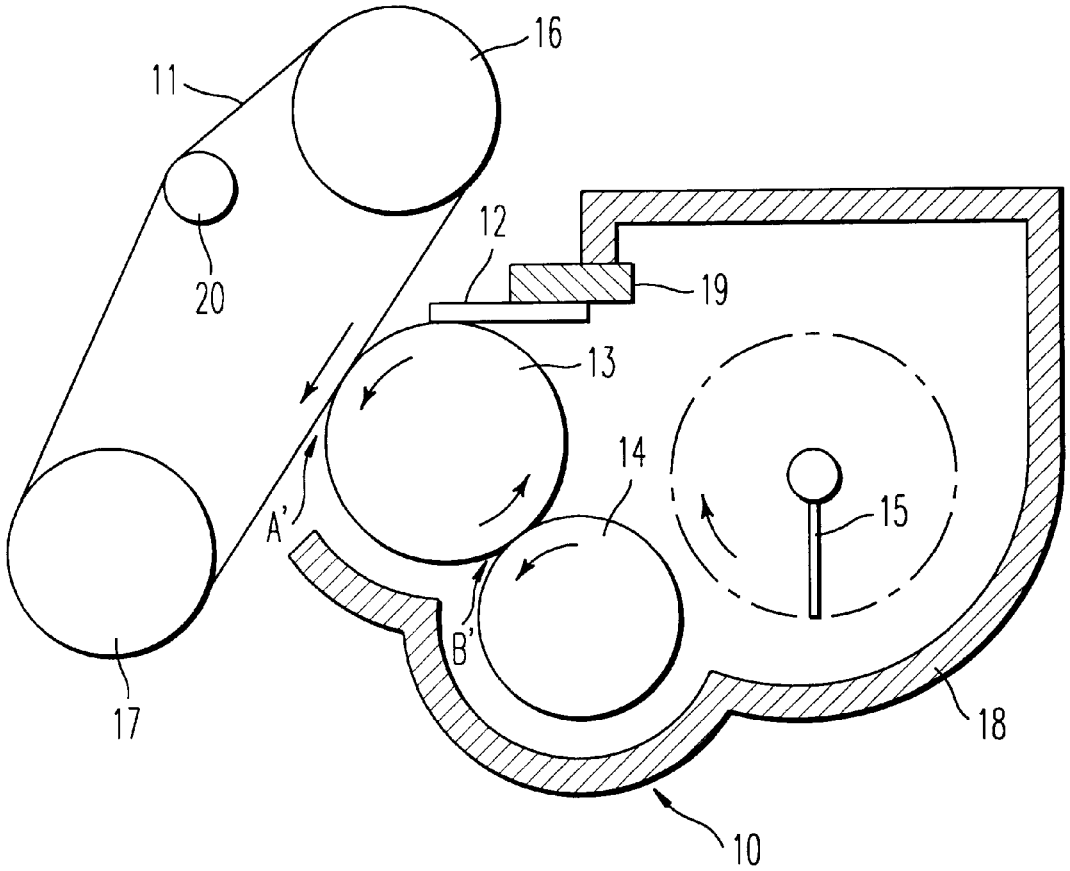
FIG. 10 is a schematic view illustrating a primary part of another embodiment of the image forming apparatus of the present invention.

FIG. 10 is a schematic view illustrating a primary part of the fourth embodiment of the image forming apparatus of the present invention. Numeral 11 denotes a photoconductor belt which serves as an image carrier and which is supported by supporting rollers 16 and 17 and rotates in a direction shown by an arrow. The photoconductor belt 11 is also supported by a tension roller 20 such that a proper tension is applied to the photoconductor belt 11. The tension can be adjusted by changing the location of the tension roller 14.

On the right side of the photoconductor belt 11, a developing device 10 is provided. The developing device 10 includes a casing 18, a developing roller 13 which serves as a developer carrier, a developer supplying roller 14, an agitator 15 and a developer regulating blade 12. The developing roller 13 is configured to contact the photoconductor belt 11 at a nip A' which locates almost in the center of the photoconductor belt 11 between the supporting rollers 16 and 17.

The developer supplying roller 14 is configured so as to contact the developing roller 13 at a nip B', and supplies a toner, which is supplied by the agitator 15, to the developing roller 13. The agitator 15 agitates the toner contained in the casing 18. The developer regulating blade 12 is disposed so that one end of the developer regulating blade 12 is secured to an end of the casing 18 with a holder 19 therebetween. The developer regulating blade 12 may be directly secured to the end of the casing 18.

In this image forming apparatus, images are formed as follows:

(1) the photoconductor belt 11 is uniformly charged with a known charging device (not shown in FIG. 10) while the photoconductor belt 11 rotates;

(2) imagewise light irradiates the photoconductor belt 11 with a known light image writing device (not shown) to form an electrostatic latent image on the photoconductor belt 11 while the photoconductor belt 11 rotates;

(3) the electrostatic latent image is visualized by being developed with the toner which is supplied by the contact of the developing roller 13 with the photoconductor belt 11;

(4) the toner image formed on the photoconductor belt 11 is then transferred onto a receiving paper which is timely fed to an image transferring position by a feeding device (not shown);

(5) the toner image transferred on the receiving paper is then fixed with a fixing device (not shown); and (6) the thus prepared copy sheet is discharged to a discharging section.

The elements of this image forming apparatus are explained in detail.

The toner contained in the developing device 10 is agitated by the clockwise rotation of the agitator 15 and mechanically supplied to the developer supplying roller 14. The developer supplying roller 14 is made of foamed polyurethane which has cells having a size of from about 50 to about 500 $\mu$m. The material of developer supplying roller 14 is not limited to foamed polyurethane. Since the developer supplying roller 14 has cells, a toner can be easily held in the cells. The developer supplying roller 14 is relatively soft and has a JIS-A hardness of from about 10 to about 30°. Since the developer supplying roller 14 is relatively soft, the developer supplying roller 14 can uniformly contact the developing roller 13.

The developer supplying roller 14 and the developing roller 13 rotate in the counterclockwise direction. Therefore at a nip B the developer supplying roller 14 and the developing roller 13 move in opposite directions. The linear speed of the developer supplying roller 14 is from 0.5 to 1.5 times the linear speed of the developing roller 13. The developer supplying roller 14 may rotate in a direction opposite to the rotating direction of the developing roller 13.

In the fourth embodiment of the image forming apparatus, the developer supplying roller 14 and the developing roller 13 rotate in the same direction as mentioned above, and the linear speed of the developer supplying roller 14 is set so as to be 0.9 times the linear speed of the developing roller 13. The depth of a deformed portion formed on the surface of the developer supplying roller 14 at the nip B' is controlled so as to fall in a range of from about 0.5 to about 1.5 mm.

The depth of the deformed portion of the developer supplying roller 14 is preferably determined depending on the charge properties and feeding properties of the toner used. Namely, a suitable depth of the deformed portion is determined so that the toner is properly charged and fed. The depth of the deformed portion is also determined by taking into consideration of the characteristics of a driving motor and gear heads which drive the developing roller 13. In this embodiment, since the effective width of the developer supplying roller 14 and the developing roller 13 is set so as to be 240 mm, the torque needed for feeding a paper sheet having a A-4 size such that the long edge of the sheet is parallel to the feeding direction is from about 0.5 to about 2.5 kg·fcm.

As for the toners, the toners mentioned in the first embodiment can also be used in this embodiment, and the same toner as used in the first embodiment is used in the fourth embodiment.

The developing roller 13 may be a metal roller or a roller in which the entire periphery of a metal roller is covered with an elastic material such as rubbers. The outside diameter of the developing roller 13 is preferably from about 10 to about 30 mm, and the surface thereof preferably has a ten-point mean roughness Rz of from about 1 to about 6 $\mu$m. Since the surface of the developing roller 13 has such a roughness Rz, i.e., since the surface roughness of the developing roller 13 is designed so as to be from 13 to 80% of the particle diameter (7.5 $\mu$m) of the toner used, the toner particles can be fed without going into concave portions of the developing roller 13. In the present invention, suitable rubbers for use in the developing roller 13 include silicone rubbers, butadiene rubbers, nitrile-butadiene rubbers, hydrin rubbers and ethylene-propylene-diene-methylene rubbers (EPDM). The surface of the developing roller 13 may be coated with a coating material such as silicone materials and fluorine-containing materials. Silicone materials can impart a satisfactory charge to the toner, and fluorine-containing materials can impart good releasability to the developing roller 13. In addition, electroconductive materials such as carbon black can be included in the developing roller 13 to improve the electroconductivity thereof. Suitable thickness of the coating layer of the developing roller 13 is from about 5 to about 50 $\mu$m to avoid breaking of the coating layer formed.

The toner which is present on the peripheral surface or in the concave portions of the foamed rubber of the developer supplying roller 14 is held on the surface of the developing roller 13 by being applied with a negative charge which is caused by the friction between the developer supplying roller 14 and the developing roller 13. In the present embodiment, a negatively-charged toner is used, however the toner is not limited thereto. The layer thickness of the toner transferred on the developing roller 13 is not uniform, and in addition, the amount of the toner is from about 1 to about 3 mg/cm$^2$, which is too excess to develop electrostatic latent images on the photoconductor belt 11.

By regulating the toner layer formed on the developing roller 13 with the developer regulating blade 12, a thin and uniform toner layer can be formed thereon. The developer regulating blade 12 is configured to extend in the same direction as the rotating direction of the developing roller 13. In this embodiment, the toner is regulated by the body of the developer regulating blade 12, however, the toner may be regulated by the top edge of the developer regulating blade 12. In addition, the developer regulating blade 12 may extend in a direction opposite to the rotating direction of the developing roller 13.

As for the developer regulating blade 12, the materials mentioned above for use in the first embodiment can also be used in this embodiment. As mentioned in the first embodiment, a bias voltage may be applied to the developer regulating blade 12.

The length of the developer regulating blade 12, which is the length of a part of the blade 12 projected from the holder 19, is preferably from about 10 to about 15 mm, to uniformly regulate the toner and to miniaturize the developing device 10.

The developer regulating blade 12 presses the developing roller 13 preferably with a pressure of from about 5 to about 250 g·f/cm to form a uniform toner layer having a proper thickness, to properly charge the toner and to prevent the passage of aggregated toner particles. In this embodiment, a roller having a JIS-A hardness of 65° is used as the developing roller 13, and a SUS plate having a thickness of 0.1 mm is used as the developer regulating blade 12. The pressure at the contact point of the developer regulating blade 12 and the developing roller 13 is set so as to be 60 g·f/cm. Under such conditions, a uniform toner layer having a desired thickness can be formed.

The developer regulating blade 12 contacts the developing roller 13 such that the angle formed by the blade 12 and the tangent line at the contact point of the developing roller 13 and the blade 12 is from about 10 to about 45°. By thus disposing the developer regulating blade 12, a uniform toner layer having a desired thickness of from about 0.4 to about 0.8 mg/cm$^2$ can be formed, and in addition the toner is charged so as to have a negative charge of from about −5 to about −30 $\mu$C/g.

The photoconductor belt 11 has a photoconductive layer which is formed on a substrate and which includes an organic and/or inorganic photoconductive material and has a friction coefficient of from about 0.1 to about 0.4, which is measured by an Euler method mentioned below. A suitable substrate for use in the photoconductor belt 11 includes polyethylene terephthalate films, nickel films and the like. The thickness of the substrate is preferably not greater than about 1 mm. The photoconductor belt 11 is supported by the supporting rollers 16 and 17 and rotated in a direction shown by an arrow.

The method for keeping the friction coefficient of a photoconductor belt in the preferred range is disclosed in, for example, in Japanese Laid-Open Patent Publication No. 4-372981. In this Publication, a lubricant is coated on the photoconductor belt. The lubricant may be directly coated or coated using an member which supports the lubricant. In addition, the lubricant may be always coated on the photoconductor belt or coated at regular intervals.

Figure 2B:
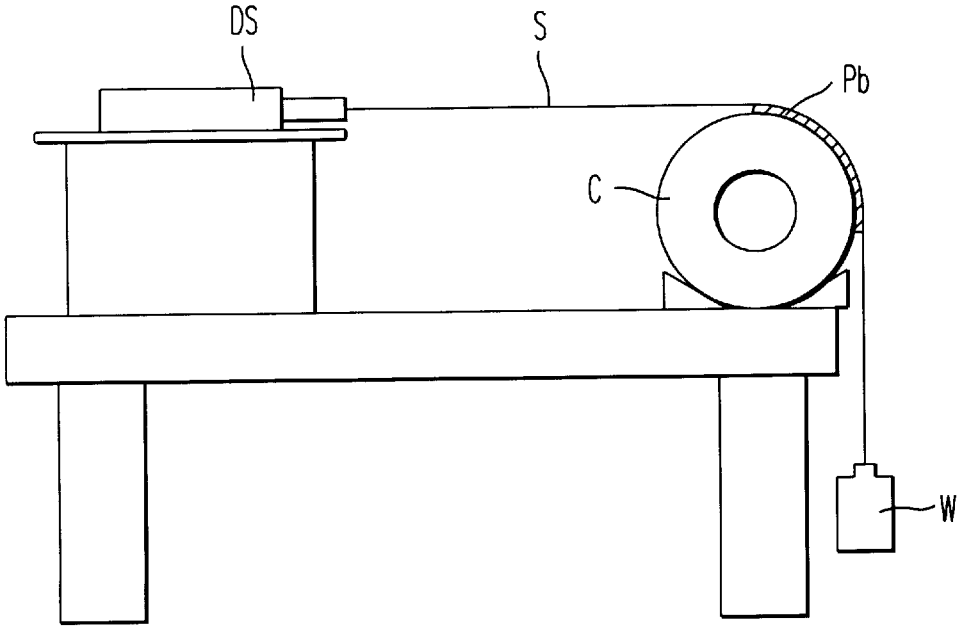
FIG. 2B is a schematic view illustrating the measuring instrument shown in FIG. 2A in which a friction coefficient of the surface of a belt-shaped photoconductor is measured.

The method for measuring the friction coefficient of the photoconductor belt 11 is almost the same as the method mentioned before in the first embodiment. FIG. 2B is a schematic view illustrating an instrument which measures friction coefficient of a photoconductor belt 11 using the Euler method. In FIG. 2B, a piece of a photoconductor belt Pb is fixed on a cylinder C such that the paper sheet S contacts the photoconductor belt Pb. This is the only difference between FIGS. 2A and 2B, and the measuring procedure is the same as that mentioned in the first embodiment.

The initial friction coefficient of a raw photoconductor belt 11, on which a lubricant is not coated, is from about 0.4 to about 0.6, and when the raw photoconductor belt 11 is used, the friction coefficient increases with time. By coating a lubricant on the surface of a photoconductor belt 11, the surface of the photoconductor belt 11 has a friction coefficient of from about 0.1 to about 0.4.

The photoconductor belt 11 rotates in the same direction as the rotating direction of the developing roller 13. As shown in FIG. 10, the photoconductor belt 11 contacts the developing roller 13 with a toner layer therebetween. The contact pressure at a nip A' of the photoconductor belt 11 and the developing roller 13 is controlled by changing the tension of the photoconductor belt 11 by changing the position of the tension roller 20.

Figure 11:
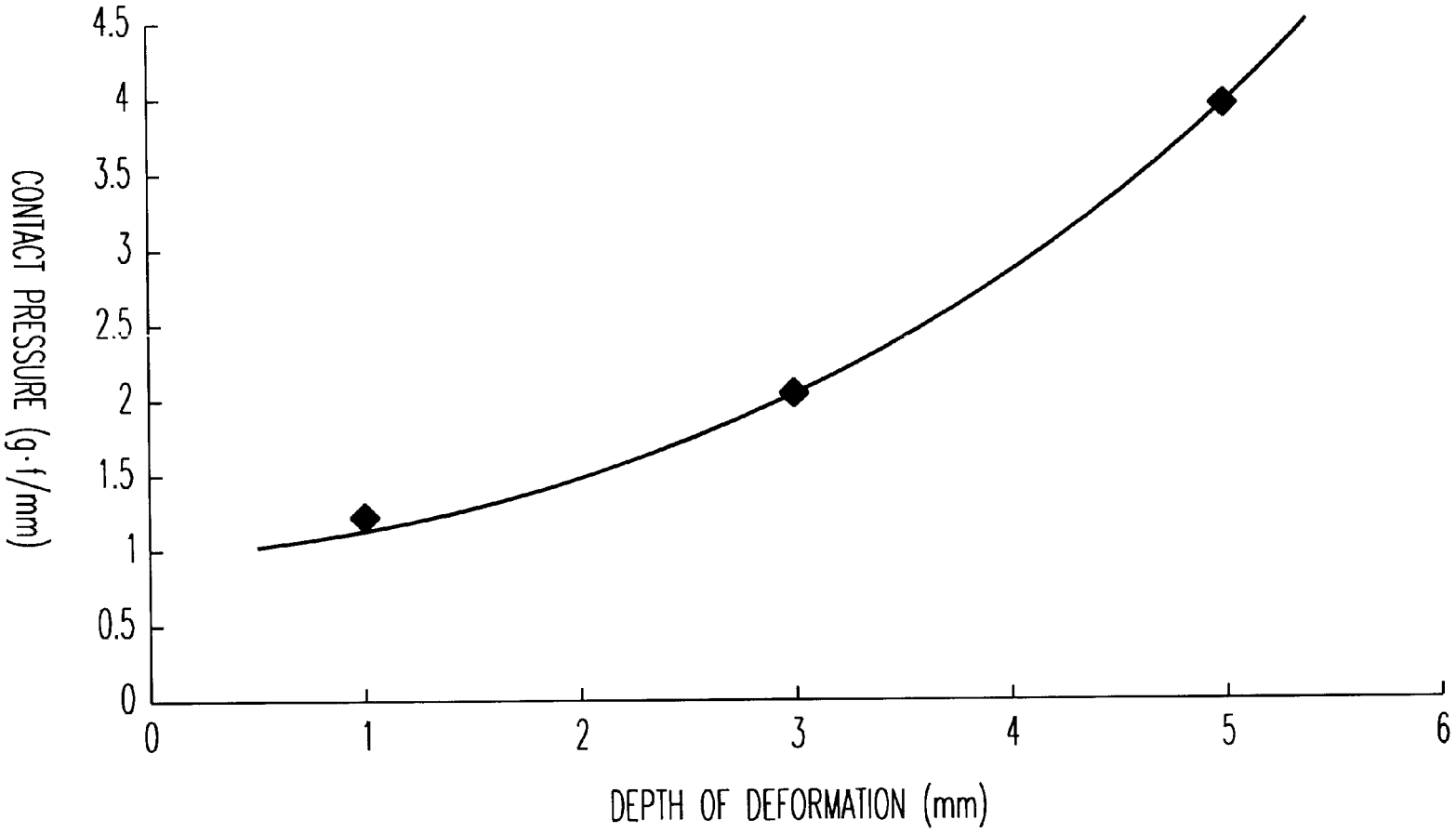
FIG. 11 is a graph illustrating the preferable relationship between a pressure of contact of the developing roller with the photoconductor belt and a depth of deformation of the photoconductor belt in the image forming apparatus shown in FIG. 10.

FIG. 11 illustrates a preferable relationship between a pressure of contact of the developing roller 13 with the photoconductor belt 11 and a depth D" of deformation of the photoconductor belt in the image forming apparatus shown in FIG. 10.

As shown in FIG. 11, in this embodiment the contact pressure is set so as to be 1.0±0.2 g·f/mm when the depth D" of deformation of the photoconductor belt 11 is set so as to be 1 mm. When a roller having a JIS-A hardness of 65° is used as the developing roller 13, the depth D" of deformation of the photoconductor belt 11 preferably falls in a range of from about 0.5 to about 6 mm. The more the tension rollers are provided, the better the contact of the photoconductor belt 11 with the developing roller 13.

Figure 12:
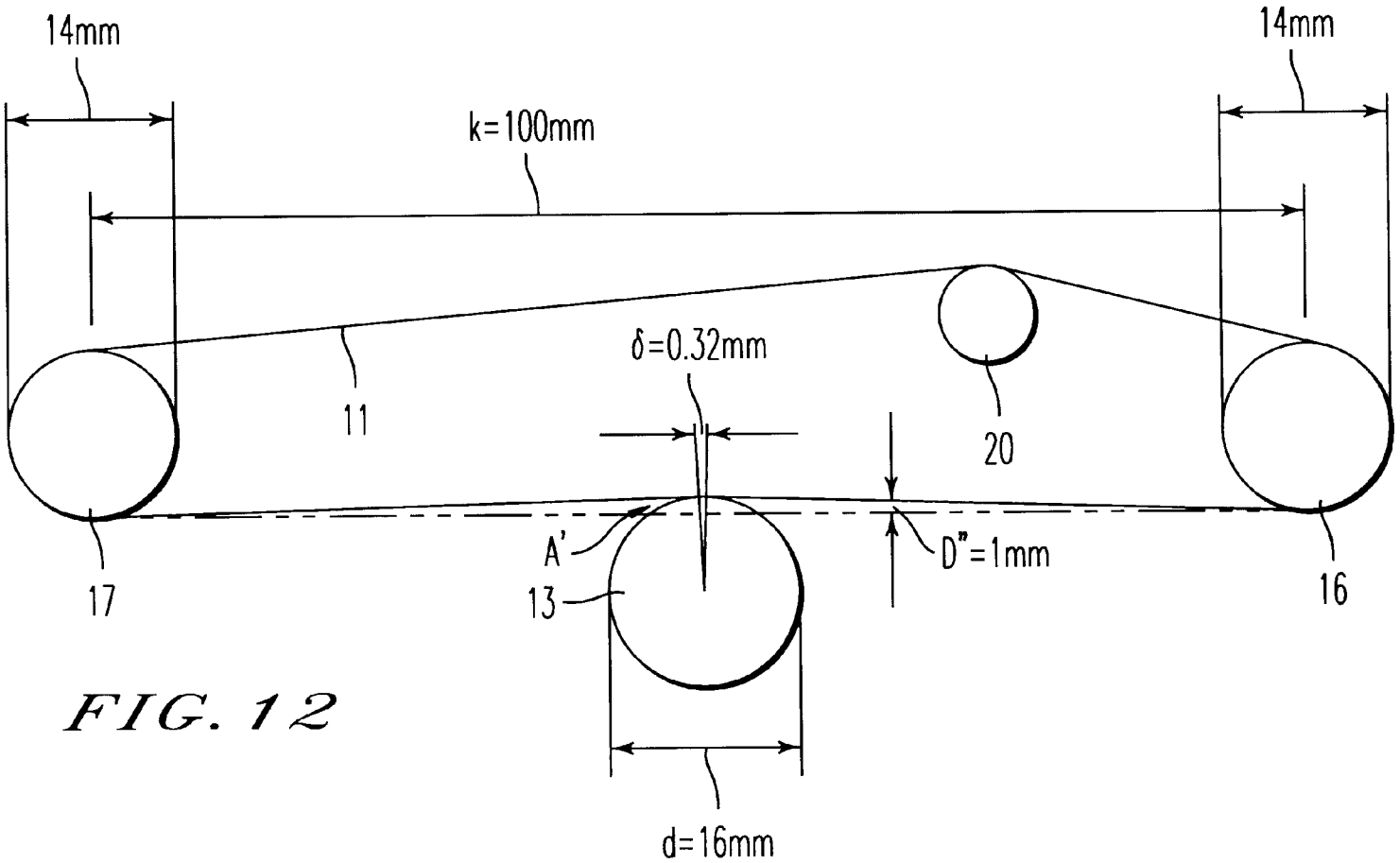
FIG. 12 is a schematic view illustrating an embodiment of contact of the developing roller with the photoconductor belt in the image forming apparatus shown in FIG. 10.

In FIG. 12, the length of the photoconductor belt 11 is 244 mm, the diameter of each of the supporting rollers 16 and 17 is 14 mm, the distance k between the central axes of the supporting rollers 16 and 17 is 100 mm, and the diameter of the developing roller 13 is 16 mm. When the depth D" of deformation of the photoconductor belt 11 is set so as to be 1 mm, the nip width δ of the nip A' is 0.32 mm. Electrostatic latent images on the photoconductor belt 11 are developed in the nip A' to form toner images. The toner images formed on the photoconductor belt 11 are then transferred on a receiving paper and then fixed to produce a hard copy.

Figure 18:
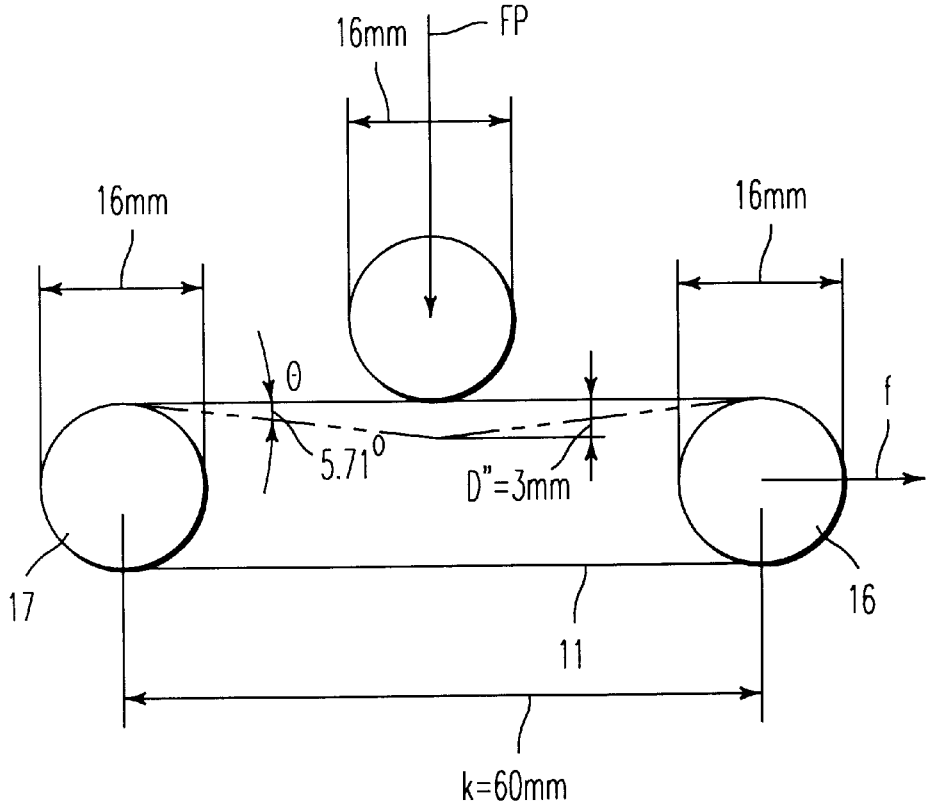
FIG. 18 is a schematic view illustrating a further embodiment of contact of the developing roller with the photoconductor belt in the image forming apparatus shown in FIG. 10.

FIG. 18 is a schematic view illustrating another embodiment of the developing roller 13 and the photoconductor belt 11 which is supported by supporting rollers 16 and 17. A pressure f of 20 g·f/mm is applied to the supporting roller 16 in a direction shown by an arrow. The contact pressure of the developing roller 13 can be practically measured when the developing roller 13 is pressed toward the photoconductor 11 by a force of FP, and in addition it can be obtained by calculation. The result in which the contact pressure is practically measured when the depth D" of deformation is 1, 3 and 5 mm is shown in FIG. 11.

Figure 19:
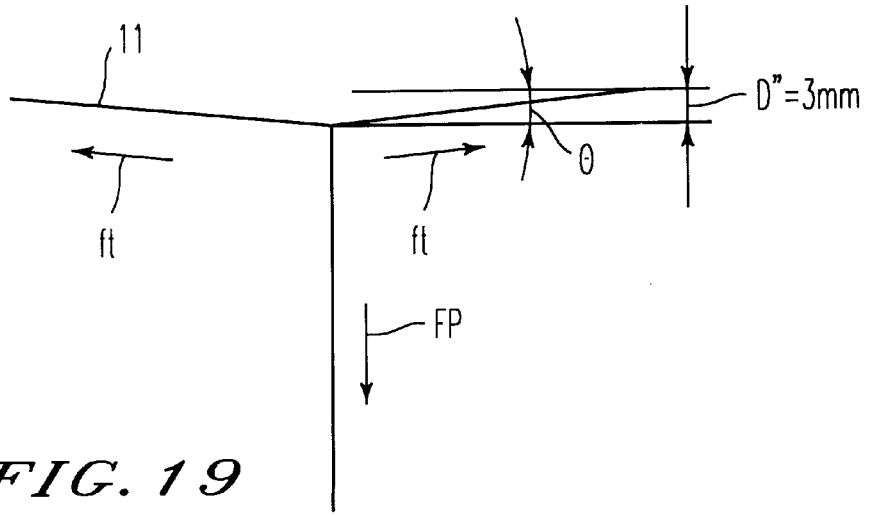
FIG. 19 is a schematic view illustrating the tensions exerted at the contact point of the photoconductor belt and the developing roller in the image forming apparatus shown in FIG. 10.

When the contact pressure is obtained by calculation, the method is the following. FIG. 19 is a schematic view illustrating the direction of tensions at the contact point of the photoconductor 11 and the developing roller 13. As shown in FIG. 18, when the depth D" of deformation is 3 mm, an angle θ is 5.7° when the distance k is 60 mm. As can be understood from FIG. 19, the contact pressure FP of the developing roller 13 is obtained by the following equation:

$$FP=2\times Ft\times \mathrm{Sin}(\theta)=2\times 10\times 0.0995=2\ \mathrm{g\cdot f/mm}$$

The result obtained by this calculation is almost equal to the result measured in practice which is shown in FIG. 11. When the friction coefficient of the photoconductor 11 is in a range of from about 0.1 to about 0.4 and the contact pressure is not greater than about 2 g·f/mm, images having good image qualities can be obtained. When the contact pressure is greater than about 2 g·f/mm, the toner image formed on the photoconductor belt 11 tends to be scavenged by the developing roller 13, resulting in deterioration of the image qualities of the resultant toner images.

When the nip width δ is greater than 2 mm, the evenness of the resultant solid image deteriorates because the toner image formed on the photoconductor belt 11 is scavenged by the developing roller 13.

Figure 13:
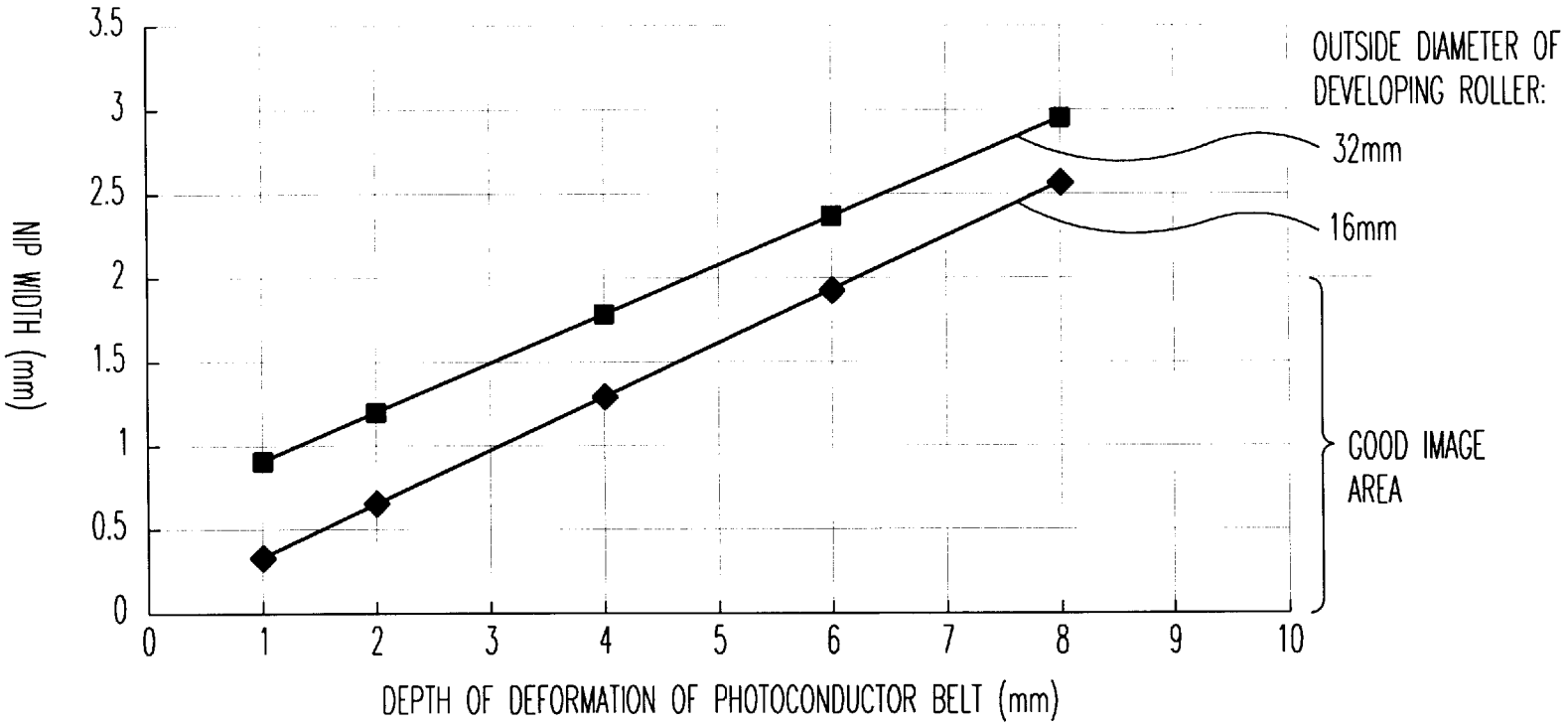
FIG. 13 is a graph illustrating the relationship between a depth of deformation of the photoconductor belt and a nip width of the nip of the photoconductor belt with the developing roller when the outside diameter of the developing roller is a parameter in the image forming apparatus shown in FIG. 10.

FIG. 13 is a graph illustrating the relationship between a depth D" of deformation of the photoconductor belt 11 and a nip width δ at the nip A' of the photoconductor belt 11 and the developing roller 13 when the outside diameter of the developing roller 13 is 16 or 32 mm. By controlling the depth D" of deformation so that the nip width δ is not greater than 2 mm, images having good image qualities can be obtained.

In the fourth embodiment of the present invention, provided when the diameter of the developing roller 13 is d and the depth of deformation of the photoconductor belt 11 is D", images having good image qualities can be obtained if the following inequality is satisfied:

$$d(\mathrm{mm})\times D''(\mathrm{mm})<100.$$

Figure 14:
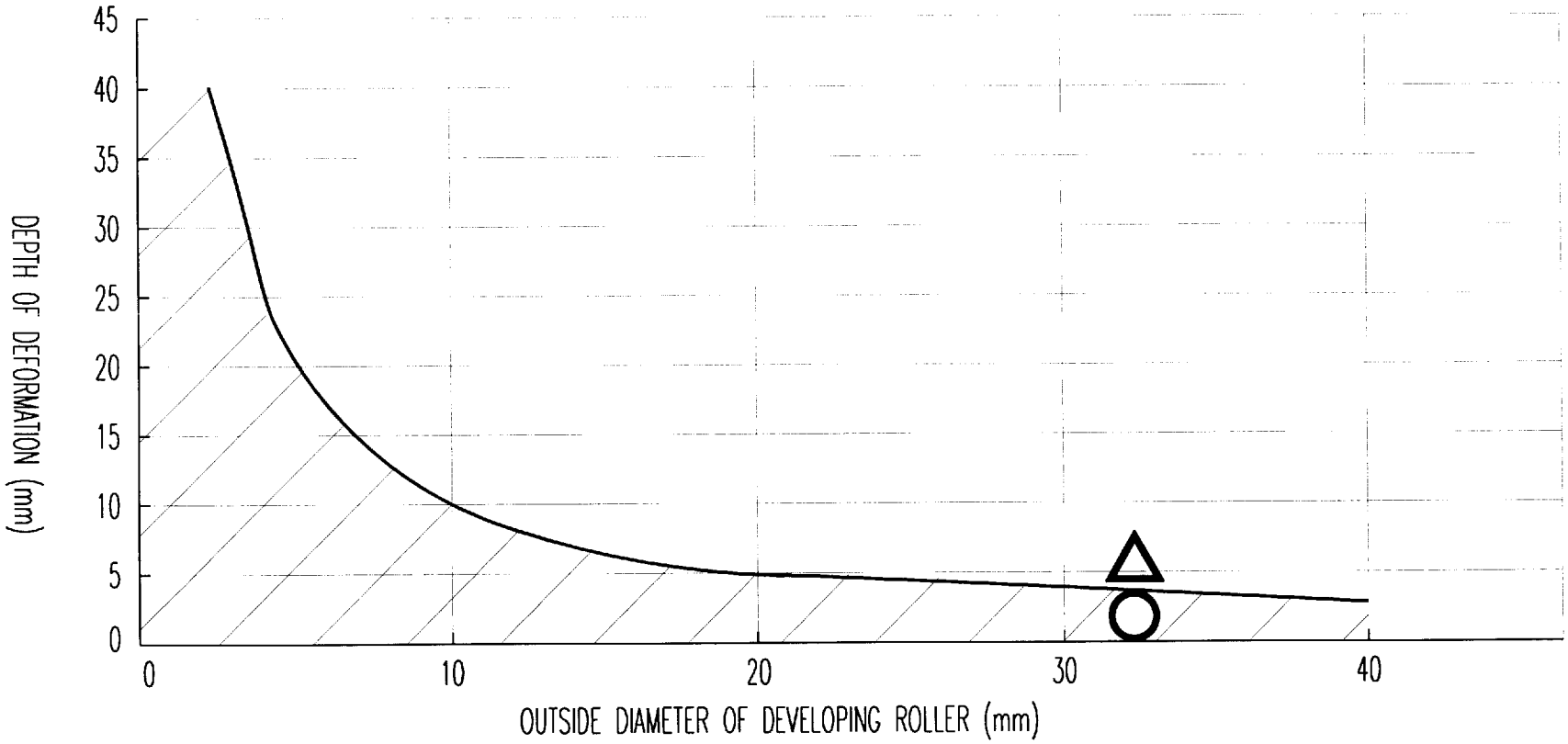
FIG. 14 is a graph illustrating an area in which good images can be formed in the relation of an outside diameter of the developing roller and a depth of deformation of the photoconductor belt in the image forming apparatus shown in FIG. 10.

FIG. 14 shows an area in which good images can be obtained in a graph illustrating the relationship of a diameter d of the developing roller 13 and a depth D" of the deformation of the photoconductor belt 11. In the conditions shown by a slantwise-lined area, in which the inequality mentioned above is satisfied, images having good evenness can be obtained. In the area out of the slantwise-lined area, the developing roller 13 tends to scavenge the toner images formed on the photoconductor belt 11, and thereby uneven solid images are formed. As can be understood from FIG. 14, by controlling the tension of the photoconductor belt 11 so as to be relatively low in addition to controlling the diameter d of the developing roller 13 and the depth D" of the deformation of the photoconductor belt 11, images having good image qualities can be easily obtained even when the depth D" of deformation of the photoconductor belt 11 is considerably changed.

Figure 15:
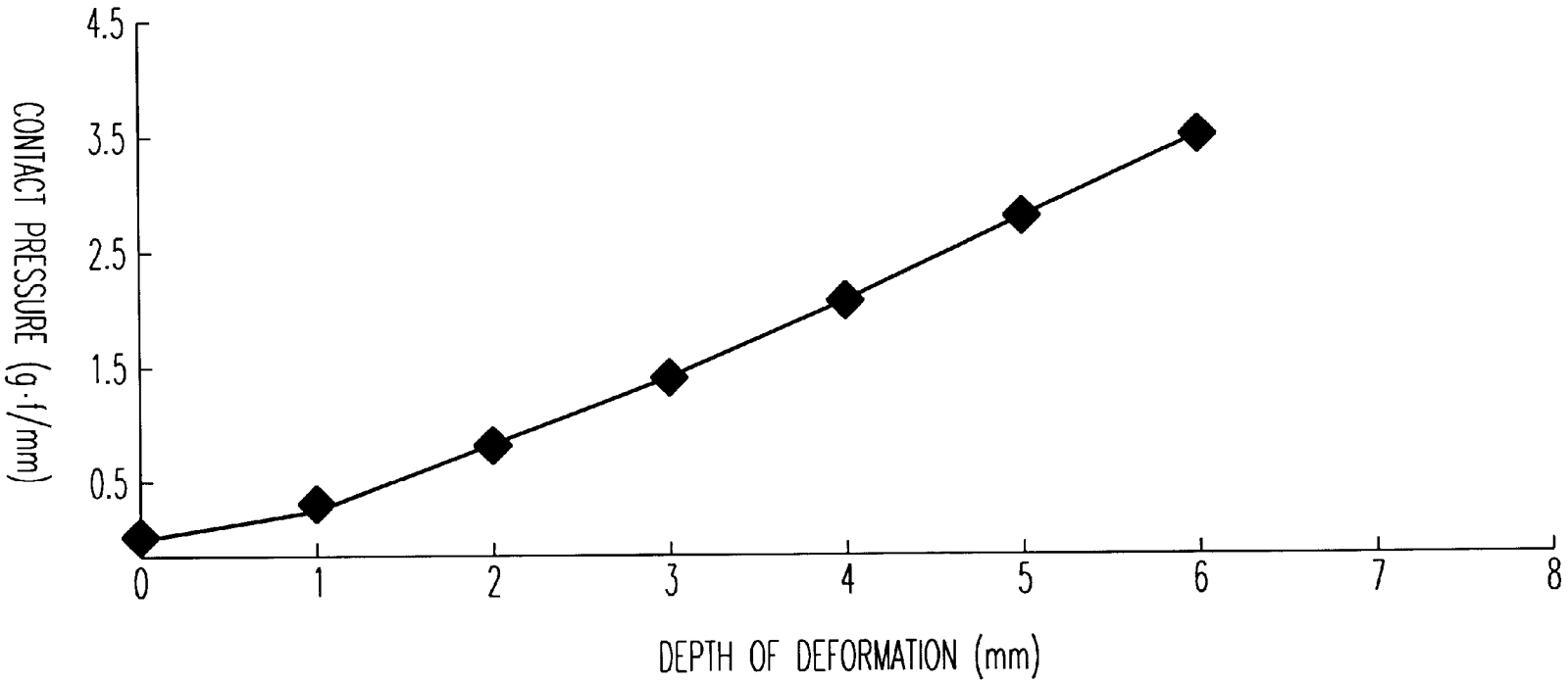
FIG. 15 is a graph illustrating the relationship between a pressure of contact of the developing roller with the photoconductor belt and a depth of deformation of the photoconductor belt when the tension of the photoconductor belt is relatively low in the image forming apparatus shown in FIG. 10.

FIG. 15 is a graph illustrating the relationship between a depth D" of deformation of the photoconductor belt 11 and a contact pressure of the developing roller 13 with the photoconductor belt 11 when the tension of the photoconductor belt 11 is set so as to be relatively low compared to the case as shown in FIG. 11.

The tension of the photoconductor belt 11 can be decreased by changing the place of the tension roller 20 or shortening the distance between the supporting rollers 16 and 17. In the present embodiment, the tension is decreased by sliding the tension roller 20 inwardly by about 2 mm. By using the thus conditioned photoconductor belt 11 and developing roller 13, images having good image qualities can be obtained even when the depth D" of deformation of the photoconductor belt 11 is considerably changed.

Figure 16:
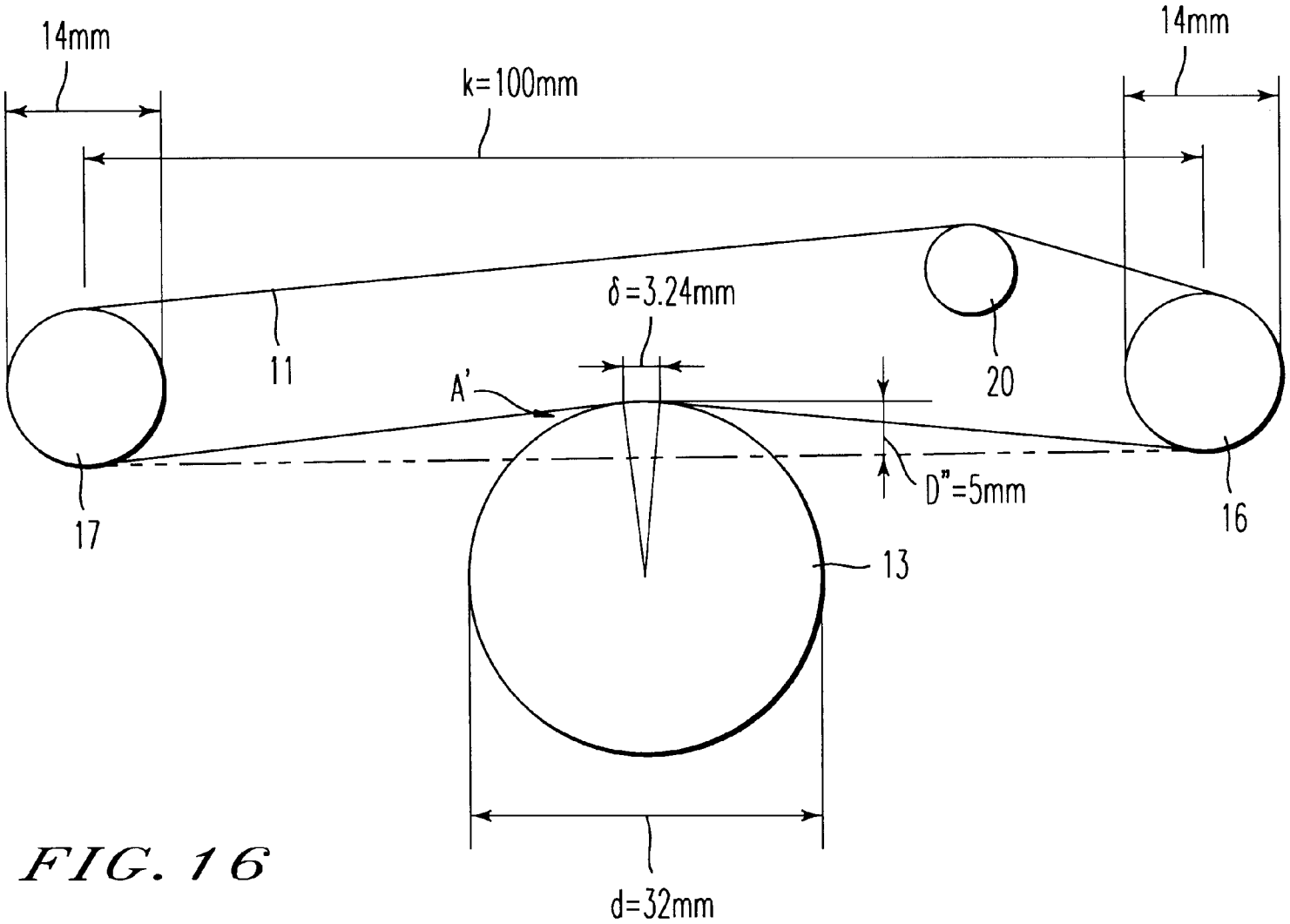
FIG. 16 is a schematic view illustrating another embodiment of contact of the developing roller with the photoconductor belt when the depth of deformation is 5 mm in the image forming apparatus shown in FIG. 10.

FIG. 16 is a schematic view illustrating a condition in which the value, d (32 mm)×D" (5 mm), is 160, which is greater than 100. The triangle mark shown in FIG. 14 represents this condition. In this condition, the nip width δ increases too much and therefore the evenness of the resultant solid images deteriorates.

Figure 17:
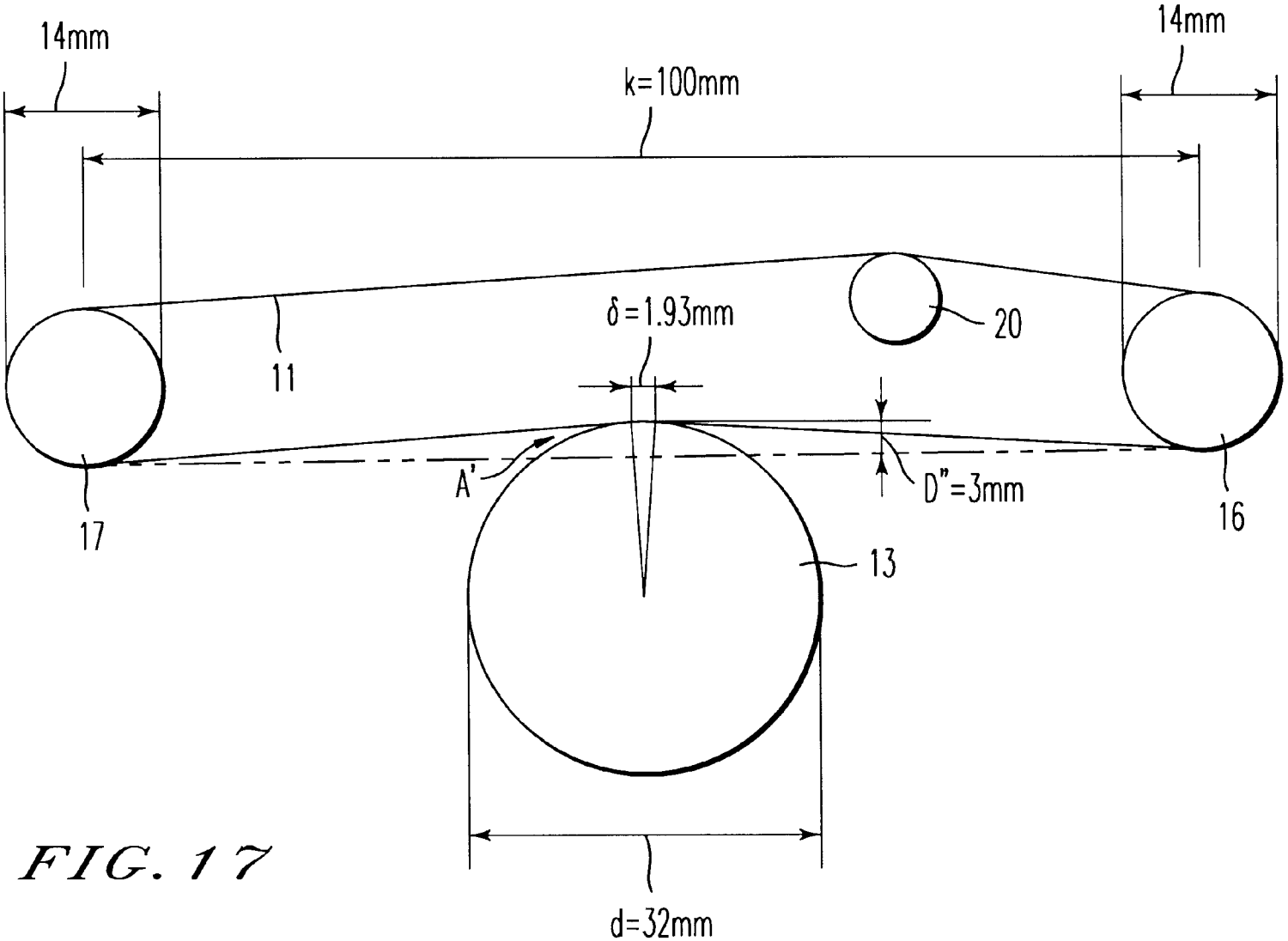
FIG. 17 is a schematic view illustrating yet another embodiment of contact of the developing roller with the photoconductor belt when the depth of deformation is 3 mm in the image forming apparatus shown in FIG. 10.

FIG. 17 is a schematic view illustrating a condition in which the value, d (32 mm)×D" (3 mm), is 96, which is not greater than 100. The circle mark shown in FIG. 14 represents this condition. In this condition, images having good image qualities can be formed.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

This document claims priority and contains subject matter related to Japanese Patent Applications Nos. 10-149106, 10-229339, 10-206140 and 10-222842 , filed on May 29, 1998, Jul. 30, 1998, Jul. 22, 1998 and Aug. 6, 1998, respectively, incorporated therein by reference.

Having now fully described the invention, it will be apparent to one of ordinary skill in the art that many changes and modifications can be made thereto without departing from the spirit and scope of the invention as set forth therein.

What is claimed and desired to be secured by Letters Patent of the United States is:

1. An image forming apparatus comprising:

a cylindrical image carrier configured to bear an electrostatic latent image while rotating; and a cylindrical developer carrier configured to bear a developer and supply the developer to the image carrier by contacting a surface of the image carrier at a nip thereof while rotating, wherein the surface of the image carrier has a static friction coefficient with respect to paper of from about 0.1 to about 0.4.

2. The image forming apparatus according to claim 1, wherein at least one of the cylindrical image carrier and the cylindrical developer carrier has a JIS-A hardness of from about 10° to about 65°.

3. The image forming apparatus according to claim 1, wherein at least one of the image carrier and the developer carrier includes a substrate material having a JIS-A hardness of from about 10° to about 65°.

4. The image forming apparatus according to claim 1, wherein the image carrier and the developer carrier contact each other at a pressure of from about 3 g·f/mm to about 16 g·f/mm.

5. The image forming apparatus according to claim 1, wherein a nip width at the nip is not greater than about 2 mm.

6. The image forming apparatus according to claim 1, wherein a ratio $d_p/d_d$ is less than about 6, where $d_p$ is an outside diameter of the image carrier, and $d_d$ is an outside diameter of the developer carrier.

7. The image forming apparatus according to claim 1, wherein a ratio Vd/Vp is not less than about 1.0, where Vp is a rotating peripheral speed of the image carrier, and Vd is a rotating peripheral speed of the developer carrier.

8. The image forming apparatus according to claim 1, wherein a ratio Vd/Vp is not greater than about 1.35, where Vp is a rotating peripheral speed of the image carrier, and Vd is a rotating peripheral speed of the developer carrier.

9. The image forming apparatus according to claim 1, wherein a surface of the developer carrier to be contacted with the surface of the image carrier has a greater friction coefficient than the surface of the image carrier, and wherein the static friction coefficient of the surface of the developer carrier with respect to paper is not greater than about 0.6.

10. The image forming apparatus according to claim 9, wherein the surface of the developer carrier has a ten-point mean roughness Rz of from about 1 μm to about 6 μm.

11. An image forming apparatus comprising:

an image carrier configured to bear an electrostatic latent image while rotating; and a cylindrical developer carrier configured to bear a developer and supply the developer to the image carrier by contacting a surface of the image carrier at a nip while rotating, wherein the image carrier comprises an endless belt and the surface of the image carrier to be contacted with the developer carrier has a static friction coefficient with respect to paper of from about 0.1 to about 0.4.

12. The image forming apparatus according to claim 11, wherein the developer carrier contacts the image carrier at a contact pressure of not greater than about 2 g·f/mm.

13. The image forming apparatus according to claim 11, wherein the nip has a length of not greater than about 2 mm.

14. The image forming apparatus according to claim 11, wherein a product of d and D" is less than about 100, where d (mm) is a diameter of the developer carrier, and D" (mm) is a depth of deformation of the image carrier formed at the nip.

15. An image forming system comprising:

cylindrical image carrier means for bearing an electrostatic latent image while rotating; and cylindrical developer carrier means for bearing a developer and for supplying the developer to the image carrier means by contacting a surface of the image carrier means at a nip thereof while rotating, wherein the surface of the image carrier means has a static friction coefficient with respect to paper of from about 0.1 to about 0.4.

16. The image forming system according to claim 15, wherein at least one of the cylindrical image carrier means and the cylindrical developer carrier means has a JIS-A hardness of from about 10° to about 65°.

17. The image forming system according to claim 15, wherein at least one of the cylindrical image carrier means and the cylindrical developer carrier means includes a substrate material having a JIS-A hardness of from about 10° to about 65°.

18. The image forming system according to claim 15, wherein the image carrier means and the developer carrier means contact each other at a pressure of from about 3 g·f/mm to about 16 g·f/mm.

19. The image forming system according to claim 15, wherein a nip width at the nip is not greater than about 2 mm.

20. The image forming system according to claim 15, wherein a ratio $d_p/d_d$ is less than about 6, where $d_p$ is an outside diameter of the image carrier means, and $d_d$ is an outside diameter of the developer carrier means.

21. The image forming system according to claim 15, wherein a ratio Vd/Vp is not less than about 1.0, where Vp is a rotating peripheral speed of the image carrier means, and Vd is a rotating peripheral speed of the developer carrier means.

22. The image forming system according to claim 15, wherein a ratio Vd/Vp is not greater than about 1.35, where Vp is a rotating peripheral speed of the image carrier means, and Vd is a rotating peripheral speed of the developer carrier means.

23. The image forming system according to claim 15, wherein a surface of the developer carrier means to tee contacted with the surface of the image carrier means has a greater friction coefficient then the surface of the image carrier means, and wherein the static friction coefficient of the surface of the developer carrier with respect to paper means is not greater than about 0.6.

24. The image forming system according to claim 23, wherein the surface of the developer carrier means has a ten-point mean roughness Rz of from about 1 $\mu$m to about 6 $\mu$m.

25. An image forming system comprising:

image carrier means for bearing an electrostatic latent image while rotating; and cylindrical developer carrier means for bearing a developer and for supplying the developer to the image carrier means by contacting a surface of the image carrier means at a nip while rotating, wherein the image carrier means comprises en endless belt and the surface of the image carrier means to be contacted with the developer carrier means has a static friction coefficient with respect to paper of from about 0.1 to about 0.4.

26. The image forming system according to claim 25, wherein the developer carrier means contacts the image carrier means at a contact pressure of not greater than about 2 g·f/mm.

27. The image forming system according to claim 25, wherein the nip has a length of not greater than about 2 mm.

28. The image forming system according to claim 25, wherein a product of d and D" is less than about 100, where d(mm) is a diameter of the developer carrier means, and D"(mm) is a depth of deformation of the image carrier means formed at the nip.

29. A method of forming an image, comprising the steps of:

forming an electrostatic latent image on a rotatable cylindrical image carrier having a surface with a static friction coefficient with respect to paper of about 0.1 to about 0.4; and supplying developer formed on a cylindrical developer carrier to the image carrier by contacting a surface of the image carrier at a nip thereof while rotating.

30. The method according to claim 29, wherein at least one of the cylindrical image carrier and the cylindrical developer carrier has a JIS-A hardness of from about 10° to 65°.

31. The method according to claim 29, wherein at least one of the cylindrical image carrier and the cylindrical developer carrier includes a substrate material having a JIS-A hardness of from about 10° to about 65°.

32. The method according to claim 29, wherein the image carrier and the developer carrier contact each other at a pressure of from about 3 g·f/mm to about 16 g·f/mm.

33. The method according to claim 29, wherein a nip width at the nip is not greater than about 2 mm.

34. The method according to claim 29, wherein a ratio $d_p/d_d$ is less than about 6, where $d_p$ is an outside diameter of the image carrier, and $d_d$ is an outside diameter of the developer carrier.

35. The method according to claim 29, wherein a ratio Vd/Vp is not less than about 1.0, where Vp is a rotating peripheral speed of the image carrier, and Vd is a rotating peripheral speed of the developer carrier.

36. The method according to claim 29, wherein a ratio Vd/Vp is not greater than about 1.35, where Vp is a rotating peripheral speed of the image carrier, and Vd is a rotating peripheral speed of the developer carrier.

37. The method according to claim 29, wherein a surface of the developer carrier to be contacted with the surface of the image carrier has a greater static friction coefficient with respect to paper than the surface of the image carrier, and wherein the static friction coefficient of the surface of the developer carrier is not greater than about 0.6.

38. The method according to claim 37, wherein the surface of the developer carrier has a ten-point mean roughness Rz of from about 1 $\mu$m to about 6 $\mu$m.

39. A method of forming an image, comprising the steps of:

forming an electrostatic latent image on a rotatable cylindrical image carrier comprising an endless belt having a surface static friction coefficient with respect to paper of from about 0.1 to about 0.4; and supplying developer formed on a cylindrical developer carrier to the image carrier by contacting a surface of the image carrier at a nip while rotating.

40. The method according to claim 39, wherein the developer carrier contacts the image carrier at a contact pressure of not greater than about 2 g·f/mm.

41. The method according to claim 39, wherein the nip has a length of not greater than about 2 mm.

42. The method according to claim 39, wherein a product of d and D" is less than about 100, where d(mm) is a diameter of the developer carrier, and D"(mm) is a depth of deformation of the image carrier formed at the nip.

* * * * *